US005441852A

United States Patent [19]

Hagiwara et al.

[11] Patent Number: 5,441,852

[45] Date of Patent: Aug. 15, 1995

[54] METHOD OF STABILIZING A COLOR SILVER HALIDE IMAGE

[75] Inventors: Moeko Hagiwara; Hiroaki Kobayashi, both of Hino, Japan

[73] Assignee: Konica Corporation, Tokyo, Japan

[21] Appl. No.: 237,248

[22] Filed: May 4, 1994

Related U.S. Application Data

[63] Continuation of Ser. No. 986,869, Dec. 4, 1992, abandoned.

[30] Foreign Application Priority Data

Dec. 27, 1991 [JP] Japan ..... 3-360631

[51] Int. Cl.[6] ..... G03C 5/39

[52] U.S. Cl. ..... 430/372; 430/428; 430/429; 430/451; 430/463; 430/490; 430/493

[58] Field of Search ..... 430/372, 428, 429, 451, 430/463, 490, 493

[56] References Cited

U.S. PATENT DOCUMENTS

| | | | |
|---|---|---|---|
| 2,767,172 | 10/1956 | Katz . | |
| 2,767,173 | 10/1956 | Katz . | |
| 2,767,174 | 10/1956 | Katz et al. . | |
| 2,870,015 | 1/1959 | Allen et al. . | |
| 3,490,911 | 1/1970 | Burness et al. . | |
| 3,545,970 | 12/1970 | Giorgianni et al. . | |
| 3,565,632 | 2/1971 | Mills et al. . | |
| 3,677,760 | 7/1972 | Iwano et al. | 430/420 |
| 3,879,202 | 4/1975 | Yamaguchi . | |
| 4,786,583 | 11/1988 | Schwartz . | |
| 4,859,574 | 8/1989 | Gormel . | |
| 5,019,479 | 5/1991 | Oka et al. | 430/192 |
| 5,087,548 | 2/1992 | Hosaka et al. | 430/193 |
| 5,110,706 | 5/1992 | Yumoto et al. | 430/191 |
| 5,110,716 | 5/1992 | Kuse et al. | 430/372 |
| 5,278,033 | 1/1994 | Hagiwara et al. | 430/429 |

FOREIGN PATENT DOCUMENTS

| | | | |
|---|---|---|---|
| 0345172 | 12/1989 | European Pat. Off. . | |
| 1919592 | 10/1969 | Germany | 430/451 |
| 1919603 | 10/1969 | Germany | 430/451 |
| 1919604 | 10/1969 | Germany | 430/451 |
| 2247582 | 4/1972 | Germany . | |
| 1152428 | 5/1969 | United Kingdom . | |

OTHER PUBLICATIONS

Chemical Abstracts, vol. 67, No. 18, 30 Oct. 1967, Columbus, Ohio, US; Abstract No. 85565U.

C. L. Liotta et al: 'Thermodynamics of acid–base equilibria. m- and p-hydroxybenzaldehyde.' & J. Phys . Chem. 71 (9), 3091-2 *Abstract*.

*Primary Examiner*—Charles L. Bowers, Jr.

*Assistant Examiner*—J. Pasterczyk

*Attorney, Agent, or Firm*—Frishauf, Holtz, Goodman & Woodward

[57] ABSTRACT

A method of processing a silver halide color photographic material by exposing the material to light, color developing, processing with a solution having a fixing function and thereafter, stabilizing the material. The stabilizing processing solution is one in for replacing formaldehyde in known processing solutions. The compound that replaces the formaldehyde is a meta substituted benzaldehyde. A method of using the processing solution is also disclosed.

9 Claims, No Drawings

METHOD OF STABILIZING A COLOR SILVER HALIDE IMAGE

This application is a Continuation, of application Ser. No. 07/986,869 , filed Dec. 4, 1992, now abandoned.

FIELD OF THE INVENTION

This invention relates to a processing solution for color photographic use and a method for processing silver halide color photographic light sensitive materials, using the processing solution. The processing technique results in a photographic image excellent in dye-image stability, and improved in scratch resistance, and improved in yellow staining resistance. The solution has excellent stability.

BACKGROUND OF THE INVENTION

When processing color photographic light sensitive materials typified by a silver halide photographic light sensitive material comprising a silver iodobromide as the silver halide thereof, a processing bath containing formaldehyde has been used in the final processing step following a washing bath.

It is known that formaldehyde used in the above-mentioned processing bath has an effect on the physical properties of color photographic-light sensitive materials and, particularly, in preventing scratching produced on the color photographic light sensitive material surface and preventing contrast variation produced by gradually hardening of the photographic light sensitive material during aging. It is also known that formaldehyde has an effect on preventing dye-image stability deterioration produced by unreacted coupler remaining in the color photographic light sensitive material.

However, when formaldehyde is added to a processing bath for the purpose of stabilizing a dye-image for example, not only can formaldehyde deteriorate the dye image stabilizing effect, but it can also accelerate sulfuration, because formaldehyde adheres to the light sensitive material and forms an adduct with sulfite ions carried over from the precedent bath (containing a processing solution having a fixing function).

For solving the above-mentioned problems, it has been proposed to use alkanol amine as described in U.S. Pat. No. 4,786,583. However, when making use of the alkanol amine, unexposed portions are affected by yellow stains and the sulfuration prevention effect cannot be said to be satisfactory.

In additional to the problems of product when using formaldehyde, as discussed above, there are serious environmental concerns. In the U.S.A., CIIT (standing for Chemical Industry Institute of Toxicity) has reported that rats developed nasal cavity cancer when exposed to 15 ppm each of formaldehyde. Also, NIOSH (standing for National Institute of Safety and Health) and ACGIH (standing for Authority Conference of Governmental Industrial Health) each warn that there is a carcinogenic possibility. Further, in Europe, formaldehyde is subject to strict regulations and, particularly in Germany, formaldehyde was regulated to be not more than 0.1 ppm in housing 10 years ago.

In Japan, legal regulations applying formaldehyde have been put into force; including laws concerning violent poisons and dangerous drugs legislated because of skin irritation, concerning poisonings from organic solvents, regulations concerning household articles, regulations concerning fibers and plywood, and formaldehyde regulations concerning underwear and baby clothing which has newly put in force since 1975 by the Ministry of Public Welfare. As mentioned above, it has been eagerly desired to provide a technology capable of reducing the use of formaldehyde.

As for the techniques for substantially eliminating or reducing a formaldehyde content of a stabilizer, the means for achieving the above-mentioned object include the use of hexahydrotriazine type compounds disclosed in Japanese Patent Publication Open to Public Inspection (hereinafter referred to as JP OPI Publication) Nos. 62-27742/1987 and 61-151538/1986 and the use of N-methylol type compounds disclosed in U.S. Pat. No. 4,859,574.

The above-mentioned hexahydrotriazine type compounds may be able to prevent dye from color-fading at high temperature and high humidity even if formaldehyde is substantially eliminated. However, there still remains a problem unsolved that the compounds do not achieve an improved effect when used at a lower humidity such as at a relative humidity of not higher than 20%. These compounds have the additional problem of preservation stability of stabilizer, that is, the stabilizer is liable to be sulfurized in particular, though the problem is not as great as in the case of formaldehyde. When a process is carried out for a long time, when processing quantity is small or when a small amount of replenishment is supplied, it was found that the above-mentioned preservation stability becomes problematic.

When the above-mentioned N-methylol type compounds are used as the compounds to substitute for formaldehyde, they are not satisfactory in dye-fading prevention effect, back side staining prevention effect or stabilizer preservation. When trying to prevent dye from color-fading, there is a problem that the preservability of a stabilizer is seriously deteriorated.

The methods for making use of a hexamethylene tetramine type compound in a stabilizer have also been disclosed. However, these methods have a defect that the dye-fading prevention effect thereof is not satisfactory under low humidity conditions, similarly the foregoing hexahydrotriazine type compounds.

As a result of the various studies made by the present inventors, they have been able to discover that a specific aromatic aldehyde can be used to achieve the object of this invention. However, the use of aromatic aldehydes in photographic processing solutions is known. For example, salicylic aldehyde, furfural, 1-hydroxy-benzene-2,4-dialdehyde and so forth described in JP OPI Publication No. 49-83441/1974, French Patent No. 1,543,694 and so forth have been used.

However, the compounds described in the art fail to provide effects to meet the objects of this invention. Unexpectedly, the inventors hereof discovered that by introducing a particular substituent into the meta position of benzaldehyde, dye fading prevention at low humidity and yellow staining prevention can be attained. The known compounds, discussed above, have substituents, but these are in the ortho or para position thereof. Therefore, the effects of the purposes of the invention are not satisfactorily displayed. The art failed to show or suggest that the above-mentioned effects can be displayed when the specific substituent is introduced into the meta position thereof, as described above. In addition to the above, it was also discovered that scratch resistance can be improved as another effect when making use of a compound of the invention and, therefore, this invention could be achieved.

It is, therefore, an object of the invention to provide a processing solution for color photographic use; wherein, first, dye-fading can be prevented at low humidity even if formaldehyde is not substantially contained; second, the scratch resistance of light sensitive materials can be improved; third, solution preservability can be excellent and, particularly, a solution which is only slightly sulfurizable can be supplied; fourth, any yellow stains which may be produced in an unexposed portions, can be reduced; and fifth, the working environment safety can be improved; and to provide the processing method therefor.

DESCRIPTION OF THE INVENTION

To be more concrete, the processing solutions for photographic use each relating to the invention are characterized in that they contain at least one of the compounds represented by the following Formula I.

Formula I

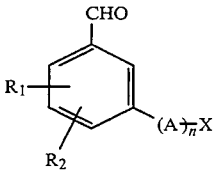

wherein A represents $$-CH_2-,\quad -CH_2\overset{CH_3}{\overset{|}{C}}H-,\quad -CH_2\overset{OH}{\overset{|}{C}}HCH_2-$$

$$\text{or}\quad -\overset{CH_3}{\overset{|}{C}}H-CH_2-;$$

X represents a hydroxyl group, a sulfonic acid group, a carboxylic acid group, an amino group, a sulfonamido group, a sulfamoyl group, a carbamoyl group, a sulfinic acid group or a sulfonyl group; n is an integer of 0 or 1 through 3; and $R_1$ and $R_2$ represent each a hydrogen atom, an alkoxy group, a lower alkyl group which may have a substituent, an aldehyde group, a hydroxyl group, a carboxylic acid group or a sulfonic acid group, provided, $R_1$ and $R_2$ may be the same with or the different from each other.

One of the preferable embodiments is that the above-mentioned processing solution for color photographic use is to be a stabilizer, that $R_1$ and $R_2$ denoted in the foregoing Formula I represent each a hydrogen atom, and that X denoted in the foregoing Formula I represents a hydroxyl group and n is 0.

Another preferable embodiment is to contain a compound represented by the following Formula SI or SII and at least one kind of the compound selected from the group consisting of water-soluble organic siloxane type compounds.

$$R^1-X-(E^1)_{l1}(E^2)_{m1}(E^3)_{n1}-R^2 \qquad \text{Formula SI}$$

wherein $R^1$ represents a hydrogen atom, an aliphatic group or an acyl group; $R^2$ represents a hydrogen atom or an aliphatic group; $E^1$ represents ethylene oxy group; $E^2$ represents propylene oxy group; $E^3$ represents ethylene oxy group; X represents an oxygen atom or an $-R^3N-$ group in which $R^3$ represents an aliphatic group, a hydrogen atom or $$(E^1)_{l2}(E^2)_{m2}(E^3)_{n2}-R^4$$

in which $R^4$ represents a hydrogen atom or an aliphatic group, $l_1$, $l_2$, $m_1$, $m_2$, $n_1$ and $n_2$ represent each one of the values from 0 to 300, provided, $l_1+l_2+m_1+m_2+n_1+n_2 \geqq 8$ $$A_2-O-(B)_m(C)_nX_1 \qquad \text{Formula SII}$$

wherein $A_2$ represents a monovalent group including, for example, an alkyl group having 6 to 50 carbon atoms and desirably 6 to 35 carbon atoms (such as any one of hexyl, heptyl, octyl, nonyl, decyl, undecyl and dodecyl groups ), or an aryl group substituted with an alkyl group having 3 to 35 carbon atoms or with an alkenyl group having 2 to 35 carbon atoms.

B and C are independently ethylene oxy group, propylene oxy group or $$(CH_2)_{n1}(\underset{OH}{\underset{|}{C}H})_{m1}(CH_2)_{l1}O-,$$

(in which $n_1$, $m_1$ and $l_1$ represent each 0, 1, 2 or 3); m and n represent each an integer of 0 to 100; and $X_1$ represents a hydrogen atom, an alkyl group, an aralkyl group or an aryl group, including, for example, the groups given for the foregoing $A_2$.

In the invention,the foregoing water-soluble organic siloxane type compounds are preferred to be the compounds represented by the following Formula SU-I Formula SU-I

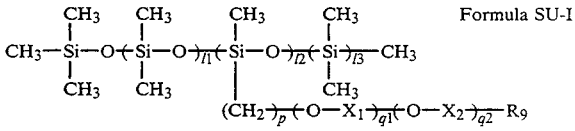

wherein $R_9$ represents a hydrogen atom, a hydroxy group, a lower alkyl group, an alkoxy group, $$-Si\begin{matrix}R_{10}\\R_{11}\\R_{12}\end{matrix}\quad\text{or}\quad -O-Si\begin{matrix}R_{10}\\R_{11}\\R_{12}\end{matrix}$$

in which $R_{10}$, $R_{11}$ and $R_{12}$ represent each a hydrogen atom or a lower alkyl group, provided, $R_{10}$, $R_{11}$ and $R_{12}$ may be the same with or the different from each other; $l_1$ through $l_3$ represent each an integer of 0 or 1 to 30; p, $q_1$ and $q_2$ represent each an integer of 0 or 1 to 30; $X_1$ and $X_2$ represent each $-CH_2CH_2-$, $-CH_2CH_2CH_2-$, $$-CH_2\underset{CH_3}{\underset{|}{C}}H-\quad\text{or}\quad -\underset{CH_3}{\underset{|}{C}}H-CH_2-$$

Further, the method for processing the silver halide color photographic light sensitive materials relating to the invention is characterized in that the silver halide color photographic light sensitive materials are processed with-the above-described processing solution for color photographic use.

In the processing method of the invention applicable with the processing solution for color photographic use, the processing steps include the following steps. However, the invention shall not be limited thereto.

(1) Color developing→Bleach-fixing→Washing→Stabilizing;
(2) Color developing→Bleaching→Fixing→Washing→Stabilizing;
(3) Color developing→Bleaching→Bleach-fixing→Washing→Stabilizing;
(4) Color developing→Bleach-fixing→Fixing→Washing→Stabilizing;
(5) Color developing→Bleach-fixing→Bleach-fixing→Washing→Stabilizing;
(6) Color developing→Fixing→Bleaching→Washing→Stabilizing;
(7) Color developing→Bleaching→Bleach-fixing→Fixing→Washing→Stabilizing;
(8) Black-and-white developing→Washing→Reversing→Color developing→Washing→Adjusting→Bleaching→Fixing→Washing→Stabilizing;
(9) Black-and-white developing→Washing→Reversing→Color developing→Washing→Adjusting→Bleach-fixing→Washing→Stabilizing;
(10) Color developing→Bleach-fixing→Stabilizing;
(11) Color developing→Bleaching→Fixing→Stabilizing;
(12) Color developing→Bleaching→Bleach-fixing→Stabilizing;
(13) Color developing→Bleach-fixing→Fixing→Stabilizing;
(14) Color developing→Bleach-fixing→Bleach-fixing→Stabilizing;
(15) Color developing→Fixing→Bleach-fixing→Stabilizing;
(16) Color developing→Bleaching→Bleach-fixing→Fixing→Stabilizing;
(17) Black-and-white developing→Washing→Reversing→Color developing→Washing→Adjusting→Bleaching→Fixing→Stabilizing; and
(18) Black-and-white developing→Washing→Reversing→Color developing→Washing→Adjusting→Bleach-fixing→Stabilizing In the invention, the desirable processing steps are the processing steps (1), (2), (8), (10), (11), (12), (16) and (17), more desirably (2), (11), (12), (16) and (17) and, preferably (2) or (11).

In the most desirable embodiment of the processing method of the invention, processing is to be carried out with a stabilizer immediately after processing with a processing solution having a bleaching function and/or a processing solution having a fixing function, or immediately after processing with a processing solution having a fixing function. When the term, 'a processing solution having a bleaching function', is used in the invention, it means, for example, a bleaching solution or a bleach-fixer each used in the above-mentioned processing-steps and, when the term, 'a processing solution having a fixing function' means, for example, a fixer or a bleach-fixer.

Next, the compounds applicable to the invention, which are represented by Formula I, will be detailed.

In Formula I,

A represents

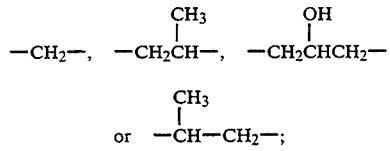

X represents a hydroxyl group, a sulfonic acid group, a carboxylic acid group, an amino group (such as an amino group, an N,N-dimethylamino group, an N-methylamino group and an N-ethylamino group), a sulfonamido group, a sulfamoyl group (such as a sulfamoyl group, an N-ethylsulfamoyl group, an N,N-dimethylsulfamoyl group, and an N-methylsulfamoyl group), a carbamoyl group (such as a carbamoyl group, an N-methylcarbamoyl group, an N,N-dimethylcarbamoyl group and an N-ethylcarbamoyl group), a sulfinic acid group or a sulfonyl group (such as a methanesulfonyl group and an ethanesulfonyl group); n is an integer of 1 to 3; and $R_1$ and $R_2$ represent each a hydrogen atom, an alkoxy group (such as a methoxy group, an ethoxy group and a methoxyethoxy group), a lower alkyl group which may have a substituent (such as a methyl group, an ethyl group, a hydroxyethyl group, a hydroxymethyl group and an acetic acid group), an aldehyde group, a hydroxyl group, a carboxylic acid group or a sulfonic acid group, provided that they may be the same with or the different from each other.

In the invention, X represents a hydroxyl group, a sulfonic acid group or a carboxylic acid group and, desirably, a hydroxyl group. $R_1$ and $R_2$ represent each, desirably, a hydrogen atom, a hydroxyl group or an aldehyde group and, particularly, a hydrogen atom n is an integer of 0 or 1 to 3 and, desirably, 0.

The exemplified compounds of the compounds represented by Formula I will be given below. However, there shall be no limitation thereto.

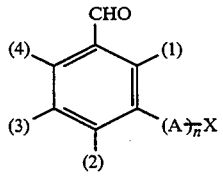

Exemplified compounds (I-1) through (I-38) can be obtained by introducing various kinds of substituents, linking groups and integers into (1) through (4), A, n and X each denoted in the above-given formula.

| Compound No. | A | n | X | (1) | (2) | (3) | (4) |
|---|---|---|---|---|---|---|---|
| I-1 | — | 0 | —OH | H | H | H | H |
| I-2 | — | 0 | $—SO_3H$ | H | H | H | H |
| I-3 | — | 0 | —COOH | H | H | H | H |
| I-4 | — | 0 | $—NH_2$ | H | H | H | H |
| I-5 | — | 0 | $—N(CH_3)_2$ | H | H | H | H |
| I-6 | — | 0 | $—SO_2NH_2$ | H | H | H | H |
| I-7 | — | 0 | $—SO_2N(CH_3)_2$ | H | H | H | H |

-continued

| Compound No. | A | n | X | (1) | (2) | (3) | (4) |
|---|---|---|---|---|---|---|---|
| I-8 | — | 0 | $-CONH_2$ | H | H | H | H |
| I-9 | — | 0 | $-CONH(CH_3)$ | H | H | H | H |
| I-10 | — | 0 | $-SO_2CH_3$ | H | H | H | H |
| I-11 | — | 0 | $-SO_2H$ | H | H | H | H |
| I-12 | — | 0 | —OH | H | $-OCH_3$ | H | H |
| I-13 | — | 0 | —OH | H | H | —CHO | H |
| I-14 | — | 0 | —OH | H | H | $-CH_3$ | H |
| I-15 | — | 0 | —OH | H | —OH | H | H |
| I-16 | — | 0 | —OH | —OH | H | H | H |
| I-17 | — | 0 | —OH | H | H | —OH | H |
| I-18 | — | 0 | —OH | H | —COOH | H | H |
| I-19 | — | 0 | —OH | H | $-CH_2CH_2OH$ | H | H |
| I-20 | — | 0 | —OH | H | $-SO_3H$ | H | H |
| I-21 | — | 0 | —OH | H | H | H | $-CH_3$ |
| I-22 | — | 0 | $-SO_3H$ | H | H | —OH | H |
| I-23 | — | 0 | —H | $-CH_3$ | H | —OH | H |
| I-24 | $-CH_2-$ | 1 | —COOH | H | H | —OH | H |
| I-25 | $-CH_2-$ | 2 | —COOH | H | H | —OH | H |
| I-26 | $-CH_2-$ | 1 | $-SO_3H$ | H | H | $-OCH_3$ | H |
| I-27 | $-CH_2-CH(OH)-CH_2-$ | 1 | —OH | H | H | —OH | $-OCH_3$ |
| I-28 | $-CH_2-CH(CH_3)-$ | 1 | —OH | H | H | —OH | H |
| I-29 | $-CH(CH_3)-CH_2-$ | 1 | —OH | H | —CHO | H | H |
| I-30 | $-CH_2-$ | 3 | —OH | H | H | —OH | H |
| I-31 | $-CH_2-$ | 1 | —COOH | H | H | H | —OH |
| I-32 | — | 0 | $-SO_2NH_2$ | H | H | —OH | H |
| I-33 | — | 0 | $-CONH_2$ | H | H | —OH | H |
| I-34 | — | 0 | $-SO_2H$ | H | H | —OH | H |
| I-35 | — | 0 | —OH | H | H | H | —OH |
| I-36 | $-CH_2-$ | 2 | —OH | $-CH_2CH_2OH$ | H | —OH | H |
| I-37 | $-CH_2-$ | 1 | —COOH | —COOH | H | H | H |
| I-38 | $-CH_2-$ | 1 | —COOH | H | —OH | H | H |

The compounds represented by Formula I can readily be available as the commercial articles on the market. The compounds represented by Formula I are contained in the processing solutions for color photographic use. The processing solutions for color photographic use, which relates to the invention, means all the processing solutions including, for example, developers, stabilizers, controllers (or conditioners), fixers, bleachers, bleach-fixers, rinses, auxiliary washers, neutralizers, stoppers, the precedent baths thereof and so forth. From the viewpoint of the effects of the objects of the invention, stabilizers, conditioners and fixers are desirably used and stabilizers are more desirably used.

The compounds may also be contained in a processing solution applicable to the precedent bath for a processing bath having a bleaching function, a processing solution having a bleaching function and a processing solution having a fixing function, as well as in a stabilizer; provided that the effects of the invention cannot be spoiled.

The compounds represented by Formula I may be added in an amount within the range of, desirably, 0.05 to 20 g, more desirably, 0.1 to 15 g and, preferably, 0.3 to 10 g, each per liter of a processing solution used.

Next, the compounds represented by the foregoing Formulas SI and SII and the water-soluble organic siloxane type compounds will be detailed below.

In Formula SI, $R^1$ represents a hydrogen atom, an aliphatic group or an acyl group; $R^2$ represents a hydrogen atom or an aliphatic group; $E^1$ represents ethylene oxy group; $E^2$ represents propylene oxy group; $E^3$ represents ethylene oxy group; X represents an oxygen atom or an $-R^3N-$ group in which $R^3$ represents an aliphatic group, a hydrogen atom of $$(E^1)_{l2}(E^2)_{m2}(E^3)_{n2}-R^4$$

in which $R^4$ represents a hydrogen atom or an aliphatic group; $l_1$, $l_2$, $m_1$, $m_2$, $n_1$ and $n_2$ represent each a value of 0 to 300, provided, $l_1+l_2+m_1+m_2+n_1+n_2 \geqq 8$.

In Formula SII, $A_2$ represents a monovalent group including, for example, an alkyl group having 6 to 50 carbon atoms and, desirably, 6 to 35 carbon atoms (such as each group of hexyl, heptyl, octyl, nonyl, decyl, undecyl or dodecyl), or an aryl group substituted with an alkyl group having 3 to 35 carbon atoms or with an alkenyl group having 2 to 35 carbon atoms.

The groups each preferably substituted onto an aryl group include, for example, an alkyl group having 1 to 18 carbon atoms (such as a non-substituted alkyl group, e.g., those of methyl, propyl, butyl, pentyl, hexyl, heptyl, octyl, nonyl, decyl, undecyl or dodecyl), a substituted alkyl group such as those of benzyl or phenethyl, and an alkenyl group having 2 to 20 carbon atoms (such as a non-substituted alkenyl group such as those of oleyl, cetyl or allyl, and an alkenyl group substituted with a styryl group or the like). The aryl groups include, for example, each of a phenyl, biphenyl, naphthyl or the like and, desirably, a phenyl group. The positions substituted to the aryl groups may be any one of the ortho, meta and para positions and a plurality of groups can be substituted;

B and C represent ethylene oxide, propylene oxide or $$(CH_2)_{n1}(\underset{\underset{OH}{|}}{CH})_{m1}(CH_2)_{l1}O-,$$

(in which $n_1$, $m_1$ and $l_1$ represent each an integer of 0, 1, 2 or 3), m and n are each an integer of 0 to 100. X represents an hydrogen atom, an alkyl group, an aralkyl group or an aryl group and includes, for example, the groups described in $A_2$).

The exemplified compounds of the compounds represented by Formulas SI and SII will be given below. However, there shall be no limitation thereto.

(Compounds represented by Formula SI)

$C_{12}H_{25}COO(C_2H_4O)_{10}H$ SI-1

$C_9H_{19}COO(C_2H_4O)_4H$ SI-2

$C_{12}H_{25}NH(C_2H_4O)_{10}H$ SI-3

$C_{12}H_{25}NH(C_2H_4O)_{15}H$ SI-4

$HO(C_2H_4O)_{20}(CH(CH_3)CH_2O)_5(C_2H_4O)_{20}H$ SI-5

$C_{12}H_{25}-NHCH_2CH_2OH$ SI-6

$C_{12}H_{25}-N(CH_2CH_2O)_{10}H)(CH_2CH_2O)_{10}H$ SI-7

$C_{12}H_{25}-N(CH_2CH_2O)_5H)(CH_2CH_2O)_5H$ SI-8

$HO(CH(CH_3)CH_2O)_{16.4}(CH_2CH_2O)_{21.6}H$ SI-9

$HO(CH(CH_3)CH_2O)_{16.4}(CH_2CH_2O)_{14.4}H$ SI-10

$HO(CH(CH_3)CH_2O)_{20.7}(CH_2CH_2O)_{18.2}H$ SI-11

$HO(CH(CH_3)CH_2O)_{30.2}(CH_2CH_2O)_{26.5}H$ SI-12

$HO(CH(CH_3)CH_2O)_{30.2}(CH_2CH_2O)_{39.8}H$ SI-13

-continued (Compounds represented by Formula SI)

$HO(CH(CH_3)CH_2O)_{30.2}(CH_2CH_2O)_{159.1}H$ SI-14

$HO(CH(CH_3)CH_2O)_{35.3}(CH_2CH_2O)_{48.6}H$ SI-15

$HO(CH(CH_3)CH_2O)_{35.3}(CH_2CH_2O)_{108.7}H$ SI-16

$HO(CH(CH_3)CH_2O)_{38.8}(CH_2CH_2O)_{34.1}H$ SI-17

$HO(CH(CH_3)CH_2O)_{38.8}(CH_2CH_2O)_{51.1}H$ SI-18

$HO(CH(CH_3)CH_2O)_{38.8}(CH_2CH_2O)_{119.3}H$ SI-19

$HO(CH(CH_3)CH_2O)_{38.8}(CH_2CH_2O)_{204.5}H$ SI-20

$HO(CH(CH_3)CH_2O)_{47.4}(CH_2CH_2O)_{41.7}H$ SI-21

$HO(CH(CH_3)CH_2O)_{56.0}(CH_2CH_2O)_{31.7}H$ SI-22

$HO(CH(CH_3)CH_2O)_{56.0}(CH_2CH_2O)_{49.2}H$ SI-23

$HO(CH(CH_3)CH_2O)_{56.0}(CH_2CH_2O)_{73.9}H$ SI-24

$HO(CH(CH_3)CH_2O)_{56.0}(CH_2CH_2O)_{295.5}H$ SI-25

$C_{12}H_{25}-O(C_2H_4O)_{10}H$ SII-1

$C_8H_{17}-O(C_3H_6O)_{15}H$ SII-2

$C_9H_{19}-O(C_2H_4O)_4H$ SII-3

$C_{10}H_{21}-O(C_2H_4O)_{15}H$ SII-4

SII-5

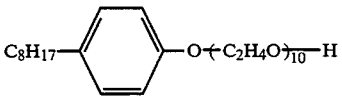

SII-6

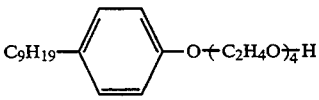

SII-7

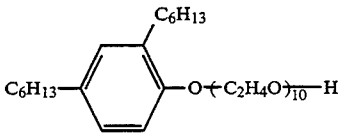

SII-8

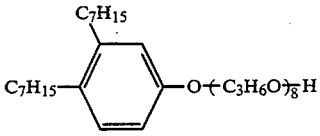

SII-9

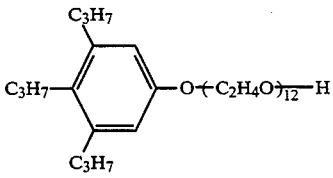

SII-10

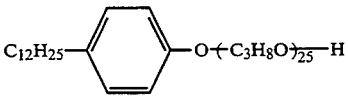

-continued
SII-11
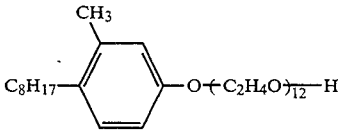
SII-12
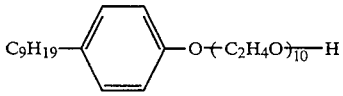
SII-13
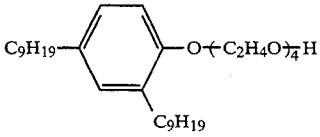
SII-14
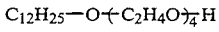
SII-15
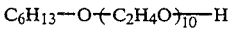
SII-16
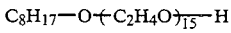
SII-17
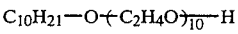
SII-18
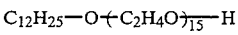
SII-19
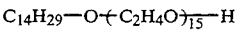
SII-20
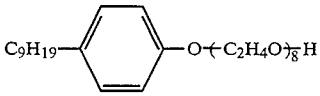
SII-21
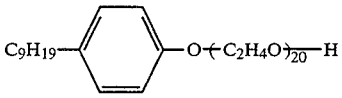
SII-22
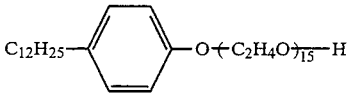
SII-23
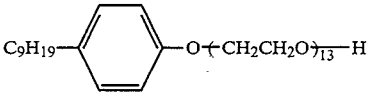
SII-24
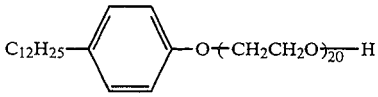
SII-25
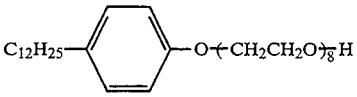
SII-26
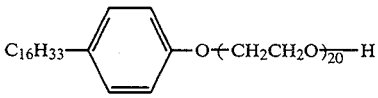
SII-27
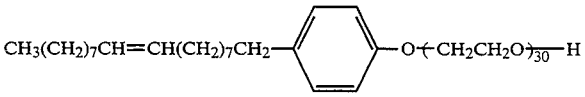
SII-28
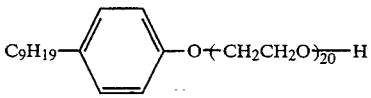
SII-29
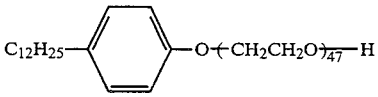
SII-30
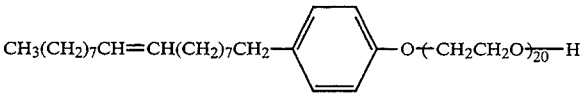
SII-31
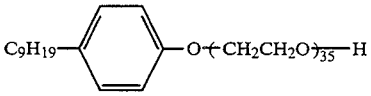
SII-32
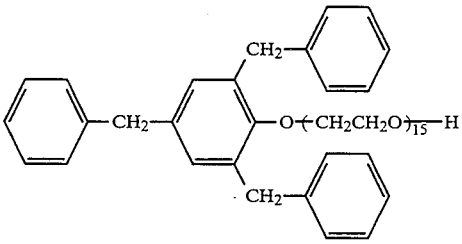
SII-33
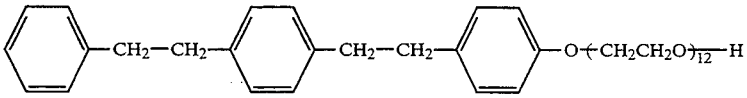
S II-34
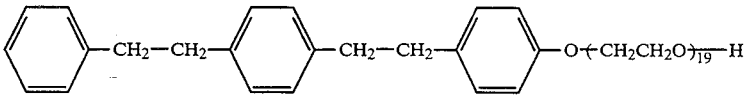

-continued
SII-35
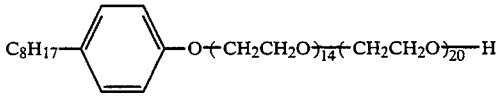
SII-36
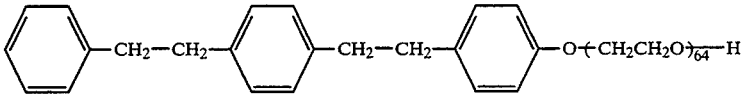
SII-37
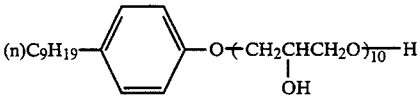
SII-38
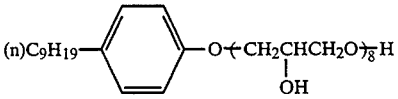
SII-39
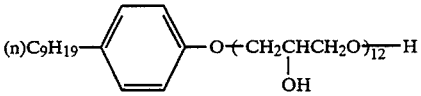
SII-40
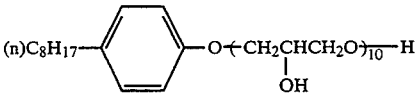
SSI-41
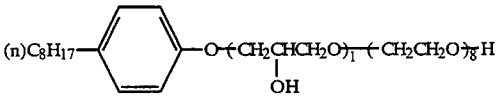
SII-42
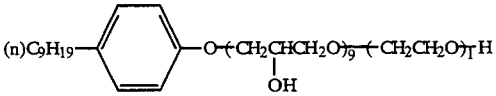
SII-43
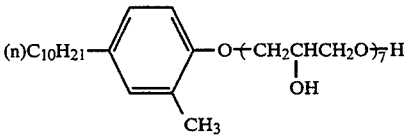
SII-44
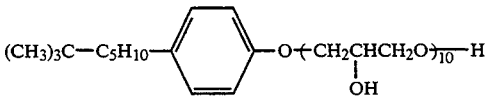
SII-45
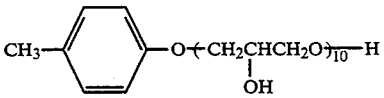
SII-46
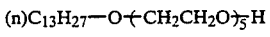
SII-47
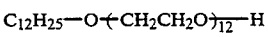
SII-48
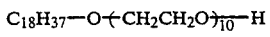
SII-49
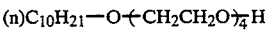
SII-50
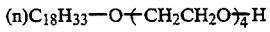
SII-51
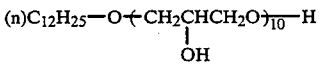
SII-52
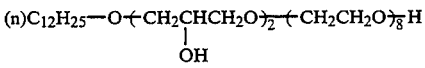
SII-53
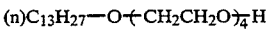
SII-54
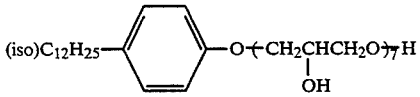
SII-55
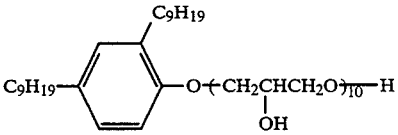
SII-56
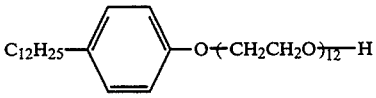
SII-57
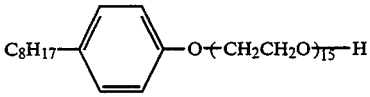
SII-58
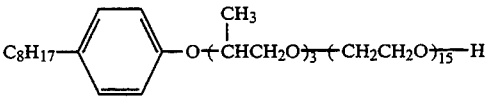
SII-59
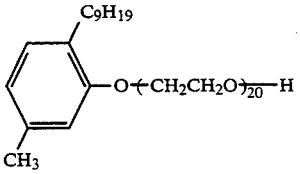
SII-60
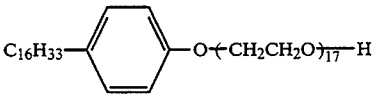

-continued

SII-61

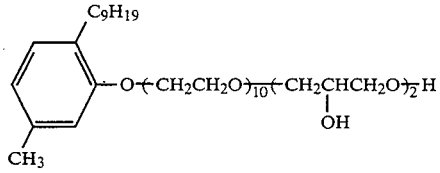

SII-62

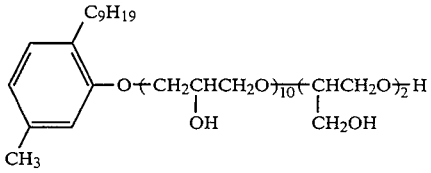

SII-63

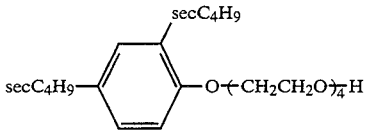

SII-64

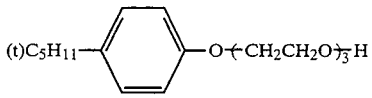

SII-65

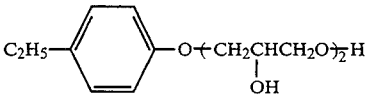

SII-66

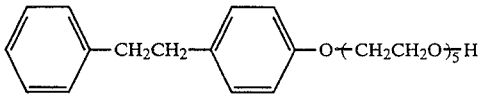

SII-67

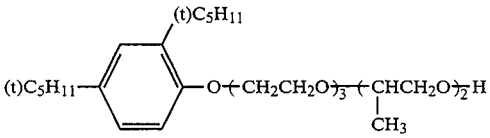

SII-68

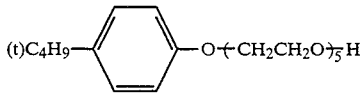

SII-69

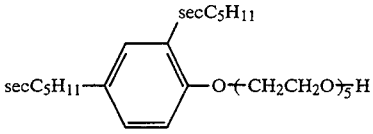

SII-70

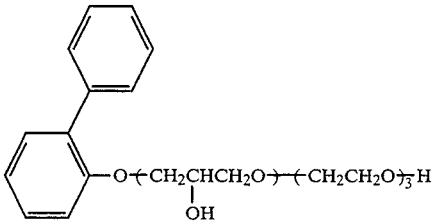

SII-71

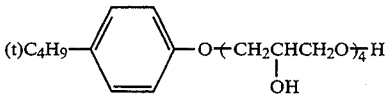

SII-72

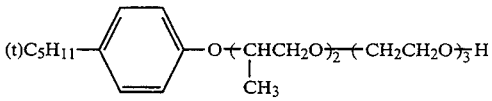

SII-73

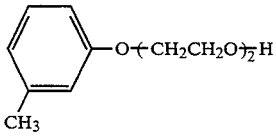

SII-74

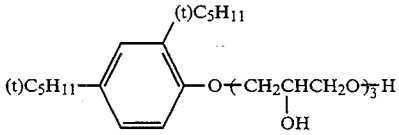

SII-75

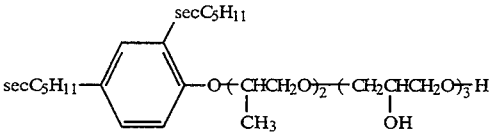

SII-76

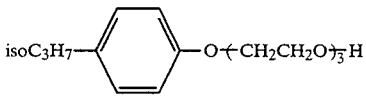

SII-77

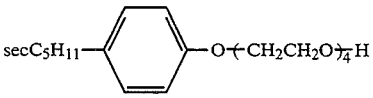

SII-78

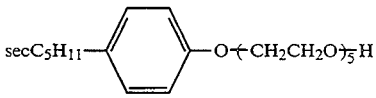

The compounds represented by Formulas SI and SII may be added in an amount within the range of, desirably, 0.1 to 40 g and, more desirably, 0.3 to 20 g each per liter of a processing solution used.

As for the water-soluble organic siloxane type compounds, the compounds represented by the above-given Formula SU-I may preferably be used.

The typical examples of the compounds represented by Formula SU-I will be given below.

(Water-soluble organic siloxane type compounds)

SU-I-1

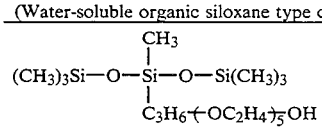

SU-I-2

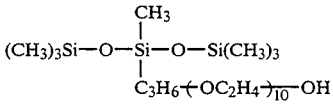

-continued (Water-soluble organic siloxane type compounds)

SU-I-3

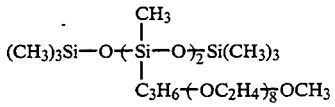

SU-I-4

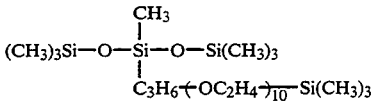

SU-I-5

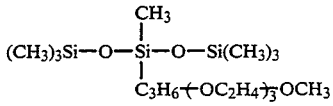

SU-I-6

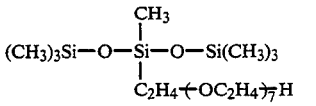

SU-I-7

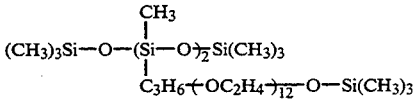

SU-I-8

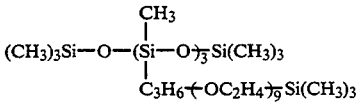

SU-I-9

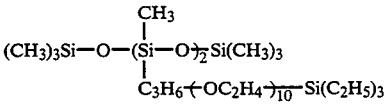

SU-I-10

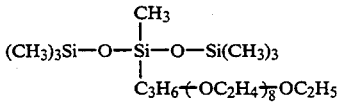

SU-I-11

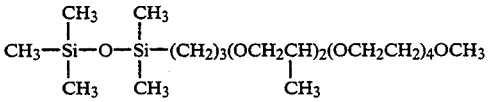

SU-I-12

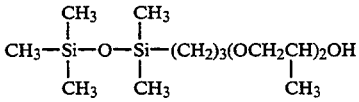

SU-I-13

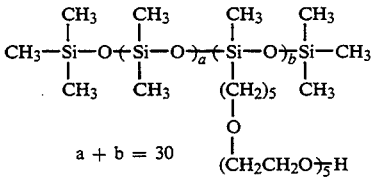

a + b = 30

SU-I-14

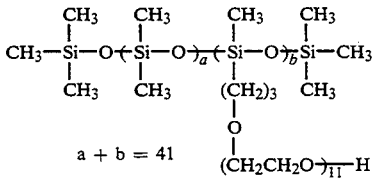

a + b = 41

-continued (Water-soluble organic siloxane type compounds)

SU-I-15

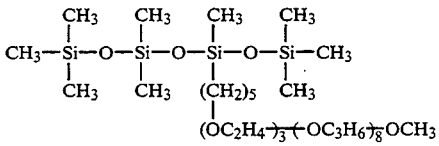

SU-I-16

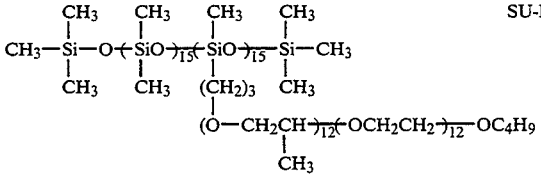

SU-I-17

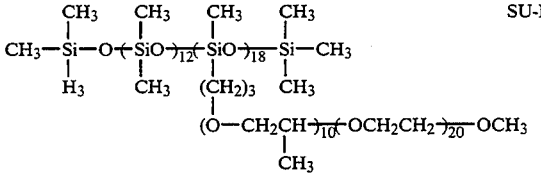

SU-I-18

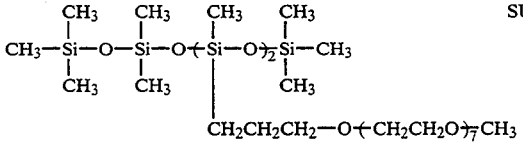

SU-I-19

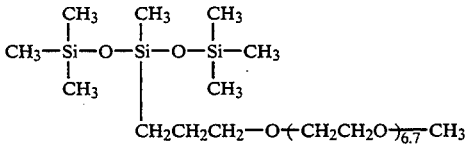

SU-I-20

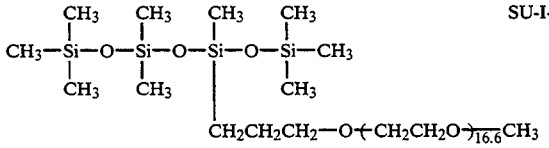

SU-I-21

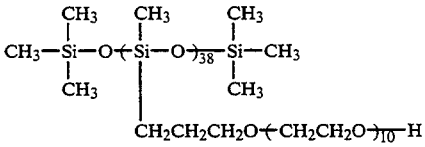

SU-I-22

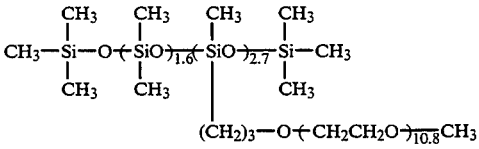

SU-I-23

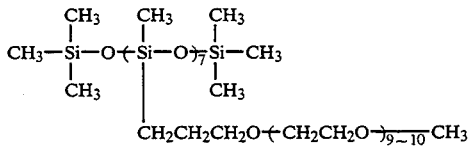

When adding the water-soluble organic siloxane type compounds each having a polyoxyalkylene group in an amount within the range of 0.01 to 20 g per liter of a processing solution, an excellent effect can be displayed and, particularly, an effect of preventing both precipitation and yellow stain from being produced.

When adding it in an amount less than 0.01 g per liter, the stains may be apparent on the surface of a light sensitive material. When adding it in an amount exceeding 20 g per liter, a large amount of the organic siloxane type compounds may adhere to the surface of a light sensitive material so that the stains may resultingly be increased.

The water-soluble organic siloxane type compounds of the invention mean such an ordinary water-soluble organic siloxane type compound as described in, for example, Japanese Patent Publication Open to Public Inspection (hereinafter referred to as JP OPI Publication) No. 47-18333/1972, JP Examined Publication Nos. 55-51172/1980 and 51-37538/1976, JP OPI Publication No. 49-62128/1974, U.S. Pat. No. 3,545,970 and so forth.

These water-soluble organic siloxane type compounds can usually be available from UCC (Union Carbide Corp. ), Shinetsu Chemical Industrial Co. and so forth.

In the invention, the amount of a processing solution and, particularly, the desirable amount of a stabilizer to be replenished, is not more than 800 ml per sq. meter of a light sensitive material and, more desirably, an amount within the range of not less than 100 ml and not more than 620 ml, because, when the amount replenished is extremely reduced, a dye may be faded and a salt may be deposited on the surface of a light sensitive material after drying the light sensitive material. A concrete amount replenished may be so set as to meet the tank constitution for a stabilizing bath and, the more the numbers of tanks are increased, the smaller the amount replenished can be reduced.

The pH values of the stabilizers of the invention are desirably within the range of 2 to 12 and, from the view point for accelerating the effects of the invention, the pH thereof is to be within the range of, desirably, 4 to 11 and, preferably, 5 to 10. The temperature of a stabilizer is to be within the range of, desirably, 15° C. to 70° C. and, more desirably, 20° C. to 55° C. Further, when making use of a stabilizer, the processing time thereof is to be within the range of, desirably, not longer than 120 seconds and within the range of, more desirably, 3 to 90 seconds and, most desirably, 6 to 60 seconds.

In the invention and when a stabilizing bath is comprised of two or more tanks, it is particularly desirable that the stabilizing bath is to be of a counter-current system (that is a system in which a replenishment is supplied to the latter tank and an overflow is made from the former tank.), from the viewpoints of the effects of the invention and, particularly, for the improvements on low pollution and image preservation.

In the invention, it is desired that a stabilizer is to contain a chelating agent having a chelating stability constant of not less than 8 to iron ions. The term, a 'chelating stability constant', means a constant generally known from L. G. Sillen & A. E. Martell, "Stability Constants of Metal-ion Complexes", The Chemical Society, London, (1964); and S. Chaberek & A. E. Martell, "Organic Sequestering Agents", Wiley, (1959) .

The typical examples of the compounds for the chelating agents having a chelating stability constant of not less than 8 to ferric ions include those given in JP Application Nos. 2-234776/1990 and 1-324507/1989.

The above-mentioned chelating agents may be used in an amount within the range of, desirably, 0.01 to 50 g and, more desirably, 0.05 to 20 g each per liter of a stabilizer used, so that an excellent result can be enjoyed.

The compounds desirably added to a stabilizer include, for example, ammonium compounds. These ammonium compounds can be supplied from the ammonium salts of a variety of inorganic compounds. Such an ammonium compound as mentioned above may be added in an amount within the range of, desirably, 0.001 to 1.0 mols and, more desirably, 0.002 to 2.0 mols each per liter of a stabilizer used.

It is desired that the above-mentioned stabilizer is to contain the above-mentioned chelating agent and a metal salt in combination. Such a metal salt as mentioned above include those of Ba, Ca, Ce, Co, In, La, Mn, Ni, Bi, Pb, Sn, Zn, Ti, Zr, Mg, A liter or Sr; and they may be supplied in the forms of a halide, a hydroxide, a sulfate, a carbonate, a phosphate, an acetate and so forth or a water-soluble chelating agent. They may be used in an amount within the range of, desirably, $1\times10^{-4}$ to $1\times10^{-1}$ mols and, more desirably, $4\times10^{-4}$ to $2\times10^{-2}$ mols each per liter of a stabilizer used.

The above-mentioned stabilizers are also allowed to be added by an organic acid salt (such as those of citric acid, acetic acid, succinic acid, benzoic acid and so forth), a pH controller (such as a phosphate, a borate, a hydrochloride, a sulfate and so forth), for example. These compounds may be added each in an amount necessary to keep the pH of a stabilizer and they may also be added in combination in any amounts without limitation, provided that the amounts thereof cannot spoil the stabilities of any photographic images in the preservation course and the prevention of any precipitation production.

The processing solutions relating to the invention are desired to contain an antimold. When making combination use of the compounds represented by the following Formulas B-1 to B-3 as such an antimold as mentioned above, they can display more excellent results of the objects of the invention.

Formula B-1

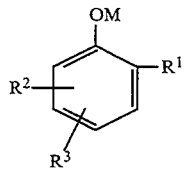

wherein $R^1$ represents an alkyl group, a cycloalkyl group, an aryl group, a hydroxyl group, an alkoxycarbonyl group, an amino group, a carboxyl group (including the salts thereof) or a sulfonic group (including the salts thereof); $R^2$ and $R^3$ represent each a hydrogen atom, a halogen atom, an amino group, a nitro group, a hydroxyl group, an alkoxycarbonyl group, a carboxyl group (including the salts thereof) or a sulfonic group (including the salts thereof); and M represents a hydrogen atom, an alkali-metal or ammonium group.

Formula B-2

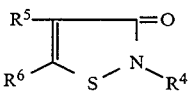

-continued

Formula B-3

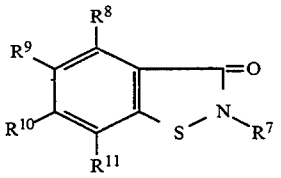

wherein $R^4$ represents a hydrogen atom, a halogen atom, an alkyl group, an aryl group, a halogenated alkyl group, —$R^{12}$—$OR^{13}$, —$CONHR^{14}$ in which $R^{12}$ represents an alkylene group and, $R^{13}$ and $R^{14}$ represent each a hydrogen atom, an alkyl group or an arylalkyl group) or an arylalkyl group; $R^5$ and $R^6$ represent each a hydrogen atom, a halogen atom, a halogenated alkyl group or an alkyl group; $R^7$ represents a hydrogen atom, a halogen atom, an alkyl group, an aryl group, a halogenated alkyl group, an arylalkyl group, —$R^{15}$—$OR^{16}$ or —$CONHR^{17}$ (in which $R^{15}$ represents an alkylene group and, $R^{16}$ and $R^{17}$ represent each a hydrogen atom or an alkyl group); $R^8$, $R^9$, $R^{10}$ and $R_{11}$ represent each a hydrogen atom, a halogen atom, a hydroxy group, an alkyl group, an amino group or a nitro group.

Next, the compounds represented by Formulas B-1 to B-3 will be detailed below. The typical examples of the compounds represented by Formula B-1 include the following exemplified compounds.

(B-1-1)

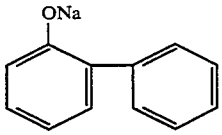

(B-1-2)

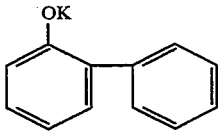

(B-1-3)

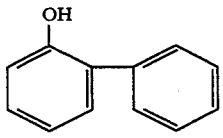

(B-1-4)

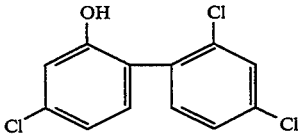

(B-1-5)

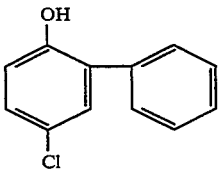

(B-1-6)

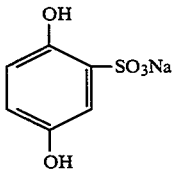

-continued (B-1-7)

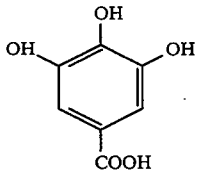

(B-1-8)

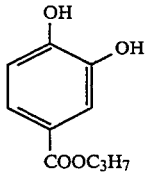

(B-1-9)

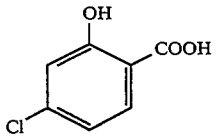

(B-1-10)

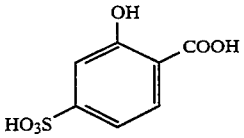

(B-1-11)

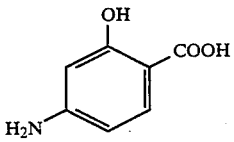

(B-1-12)

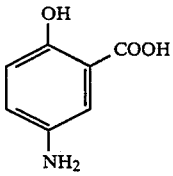

(B-1-13)

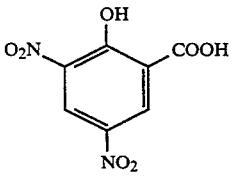

(B-1-14)

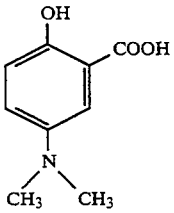

(B-1-15)

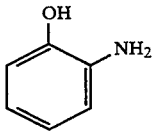

(B-1-16)

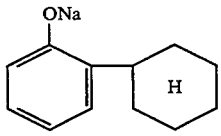

-continued

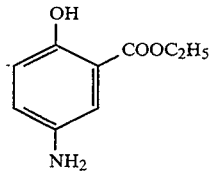

(B-1-17)

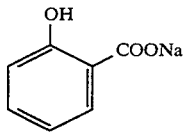

(B-1-18)

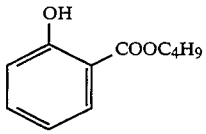

(B-1-19)

The compounds represented by the above-given Formula B-1 include those known as an antimold for mandarin oranges as a part of the compounds readily obtainable by the skilled in the art, because they are available on the market. Among these exemplified compounds given above, the desirable compounds include B-1-1, B-1-2, B-1-3, B-1-4 and B-1-5.

The above-given compounds represented by Formula B-1 which are applicable to the invention may be used in an amount within the range of, desirably, 0.03 to 50 g, more desirably, 0.12 to 10 g and, particularly, 0.15 to 5 g, each per liter of a processing solution of the invention.

The typical examples of the compounds represented by the foregoing Formulas B-2 and B-3 will be given below. However, there shall not be any limitation thereto.

[B-2-1] 2-methyl-4-isothiazoline-3-one,
[B-2-2] 5-chloro-2-methyl-4-isothiazoline-3-one,
[B-2-3] 2-methyl-5-phenyl-4-thiazoline-3-one,
[B-2-4] 4-bromo-5-chloro-2-methyl-4-isothiazoline-3-one,
[B-2-5] 2-hydroxymethyl-.4-isothiazoline-3-one,
[B-2-6] 2-(2-ethoxyethyl)-4-isothiazoline-3-one,
[B-2-7] 2-(N-methyl-carbamoyl)-4-isothiazoline-3-one,
[B-2-8] 5-bromomethyl-2-(N-dichlorophenyl-carbamoyl)-4-isothiazoline-3-one,
[B-2-9] 5-chloro-2-(2-phenylethyl)-4-isothiazoline-3-one,
[B-2-10] 4-methyl-2-(3,4-dichlorophenyl)-4-isothiazoline-3-one,
[B-3-1] 1,2-benzisothiazoline-3-one,
[B-3-2] 2-(2-bromoethyl)-1,2-benzisothiazoline-3-one,
[B-3-3] 2-methyl-1,2-benzisothiazoline-3-one,
[B-3-4] 2-ethyl-5-nitro-1,2-benzisothiazoline-3-one,
[B-3-5] 2-benzyl-1,2-benzisothiazoline-3-one,
[B-3-6] 5-chloro-1,2-benzisothiazoline-3-one.

The methods for synthesizing these exemplified compounds and the application of the compounds to the other fields are described in U.S. Pat. Nos. 2,767,172, 2,767,173, 2,767,174 and 2,870,015, British Patent No. 848,130, French Patent No. 1,555,416 and so forth. Some of these compounds are on the market and they are available under the brand names such as Topside 300 (manufactured by Permchem Asia Co.), Topside 600 (manufactured by Permchem Asia Co.), Fineside J-700 (manufactured by Tokyo Fine Chemical Co. ) and Proxel GXL (manufactured by I.C.I.).

The compounds represented by Formula B-2 or B-3 may be used in an amount within the range of desirably, 0.001 to 20 g and, more desirably, 0.005 to 5 g, each per liter of a processing solution of the invention used.

In the inventive processes, silver can be recovered from the processing solutions used. For example, an electrolysis method (such as described in French Patent No. 2,299,667), a precipitation method (such as described in JP OPI Publication No. 52-73037/1977 and German Patent No. 2,331,220), an ion-exchange method (such as described in JP OPI Publication No. 51-17114/1976 and German Patent No. 2,548,237) and a metallic replacement method (such as described in British Patent No. 1,353,805) can effectively be utilized. The above-mentioned silver recoveries are particularly desirable, because the rapid processing ability thereof can further be improved when silver is recovered from a tank solution either in an electrolysis method or in an in-line system by making use of an anion-exchange resin. Silver may also be recovered from waste overflow solutions and then the recovered silver may be reused.

When a processing solution of the invention including, particularly, a stabilizer of the invention is processed in an ion-exchange method, an electrodialysis method (such as described in JP OPI Publication No. 61-28949/1986) or a reverse osmosis method (such as described in JP OPI Publication Nos. 60-240153/1985 and 62-254151/1987), the effects of the invention can be more remarkable. It is, therefore, desirable to apply these processes. It is also desirable to apply water demineralized in advance to a stabilizer, because the antimold property and stability of a subject stabilizer and an image preservability can be improved. Any means of the above-mentioned demineralization can be used, provided, the Ca and Mg ions of washing water cannot be higher than 5 ppm after completing the above-mentioned processes. For example, a process is desired to be carried out by making independent or combination use of ion-exchange resins and reverse osmotic membranes. The above-mentioned ion-exchange resins and reverse osmotic membranes are detailed in Technical bulletin Open to Public Inspection Nos. 87-1984 and 89-20511.

After completing a stabilizing step, no washing step is needed at all. However, if desired, it is allowed to carry out a rinse, a surface washing and so forth by making use of a small amount of washing water for a substantially short time.

The color developing agents applicable to a color developing step include, for example, an aminophenol type compound and a p-phenylenediamine type compound. In the invention, it is desired to use a p-phenylenediamine type compound having a water-soluble group. Such a water-soluble group as mentioned above may be at least one of them positioned on the amino group of a p-phenylenediamine type compound or on the benzene nucleus thereof.

The typical water-soluble groups desirably applicable thereto include, for example, $-(CH_2)_n-CH_2OH$,

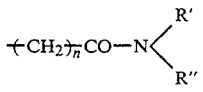

$-(CH_2)_m-NHSO_2-(CH_2)_n-CH_3$, $-(CH_2)_mO-(CH_2)_n-CH_3$, $-(CH_2CH_2O)_nC_mH_{2m+1}$ (in which m and n are each an integer of not less than 0; and R′ and R″ represent each a hydrogen atom or a lower alkyl group), —COOH group or $-SO_3H$ group.

Typical examples of the color developing agents desirably applicable to the invention include those given in JP OPI Publication No. 3-229249/1991, JP Application Nos. 1-324507/1989 and 2-234776/1990 and JP OPI Publication No. 3-246542/1991.

The above-mentioned color developing agents may be added in an amount of, desirably, not less than $0.5\times10^{-2}$ mols, more desirably, within the range of $1.0\times10^{-2}$ to $1.0\times10^{-1}$ mols and, most desirably, $1.5\times10^{-2}$ to $7.0\times10^{-2}$ mols, each per liter of a color developer used.

The color developers applicable to a color developing step are allowed to contain any compounds ordinarily used in developers.

The pH values of the color developers are usually not lower than 7 and, desirably, within the range of about 9 to 13.

With color photographic light sensitive materials for phototaking use, the desirable amount of a color developer to be replenished into a continuous processing steps is, desirably, not more than 1.5 liters and within the range of, more desirably, 100 ml to 900 ml and, further desirably, 200 ml to 700 ml, each per 1.0 $m^2$ of the light sensitive material subject to the development.

In the invention, the bleaching agents desirably applicable to a bleaching solution or a bleach-fixer include, for example, the ferric complexes of an organic acid represented by the following Formula A, B or C.

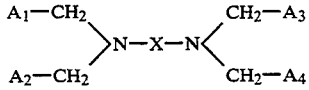

Formula A wherein $A_1$ through $A_4$ may be the same with or the different from each other and represent each $-CH_2OH$, —COOM or $-PO_3M_1M_2$ in which M, $M_1$ and $M_2$ represent each a hydrogen atom, an alkali-metal (such as sodium and potassium) or ammonium; and X represents a substituted or unsubstituted alkylene group having 3 to 6 carbon atoms (such as those of propylene, butylene or pentamethylene), in which the substituents include a hydroxyl group or an alkyl group having 1 to 3 carbon atoms.

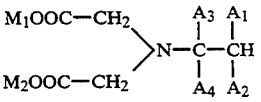

Formula B wherein $A_1$, $A_2$, $A_3$ and $A_4$ may be the same with or the different from each other and represent each a hydrogen atom, a hydroxyl group, —COOM, $-PO_3M_2$, $-CH_2OH$ or an a lower alkyl group (such as a methyl group, an ethyl group, an isopropyl group and an n-propyl group), provided, at least one of $A_1$, $A_2$, $A_3$ and $A_4$ represents —COOM or $-PO_3M_2$; and M, $M_1$ and $M_2$ represent each a hydrogen atom, an ammonium group, a sodium atom, a potassium atom, a lithium atom or an organic ammonium group (such as a trimethyl ammonium group and a triethanol ammonium group).

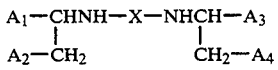

Formula C wherein $A_1$ through $A_4$ may be the same with or the different from each other and represent each $-CH_2OH$, $-PO_3M_2$ or —COOM, in which M represents a hydrogen atom, an alkali-metal (such as sodium and potassium) or other cation (such as ammonium, methyl ammonium and trimethyl ammonium); and X represents a substituted or unsubstituted alkylene group having 2 to 6 carbon atoms or $-(B_1O)_n-B_2$, in which $B_1$ and $B_2$ may be the same with or the different from each other and represent each a substituted or unsubstituted alkylene group having 1 to 5 carbon atoms. The alkylene groups each represented by X include, for example, ethylene, trimethylene, tetramethylene and so forth. The alkylene groups each represented by $B_1$ and $B_2$ include, for example, methylene, ethylene and trimethylene:. The substituents of the alkylene groups represented by X, $B_1$ and $B_2$ include, for example, a hydroxyl group, an alkyl group having 1 to 3 carbon atoms (such as a methyl group and an ethyl group). n is an integer of 1 to 8 and, desirably, 1 to 4.

The typical examples of the compounds represented by Formulas A, B and C will be given below.

(Typical examples represented by Formula A)

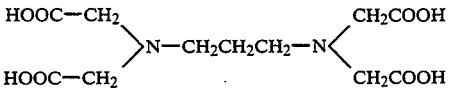

(A-1)

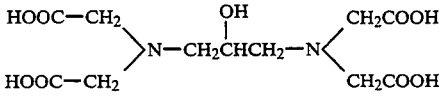

(A-2)

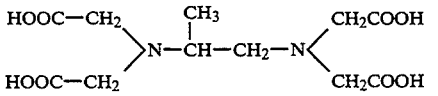

(A-3)

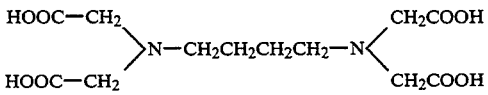

(A-4)

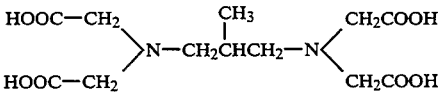

(A-5)

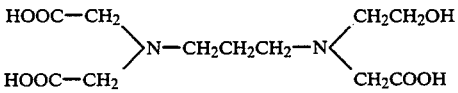

(A-6)

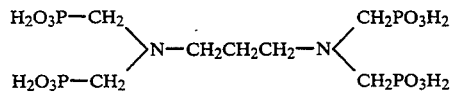

(A-7)

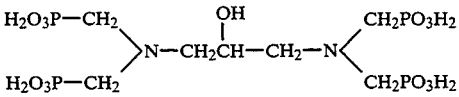

(A-8)

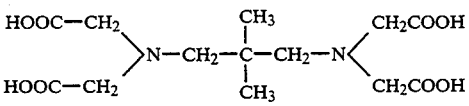

(A-9)

-continued
(Typical examples represented by Formula A)
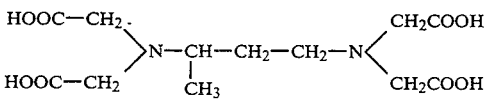
(A-10)
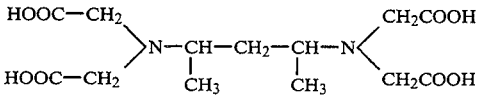
(A-11)
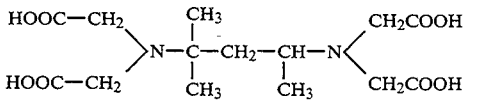
(A-12)
(Typical examples represented by Formula B)
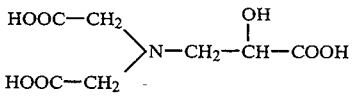
(B-1)
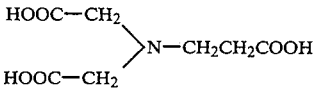
(B-2)
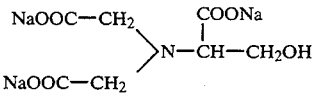
(B-3)
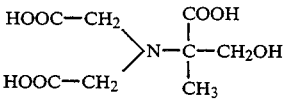
(B-4)
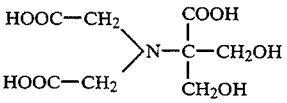
(B-5)
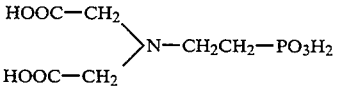
(B-6)
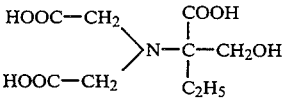
(B-7)
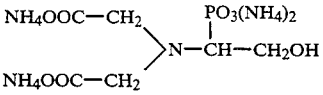
(B-8)
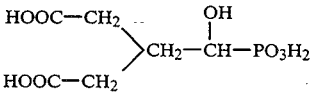
(B-9)
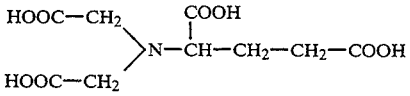
(B-10)
(Typical examples represented by Formula C)
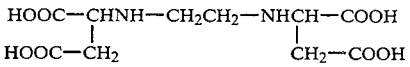
C-1
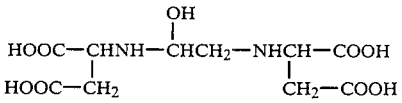
C-2
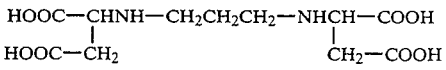
C-3
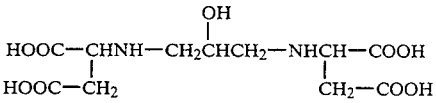
C-4
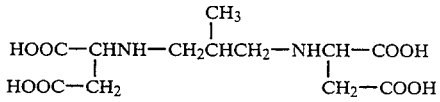
C-5
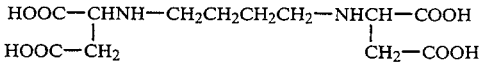
C-6
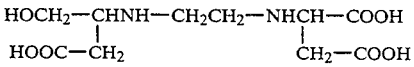
C-7
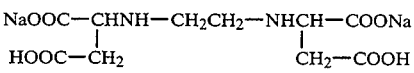
C-8
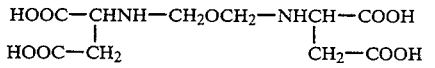
C-9
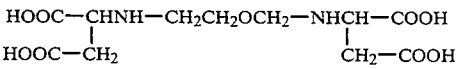
C-10
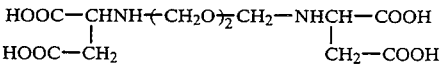
C-11
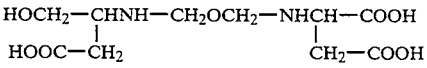
C-12
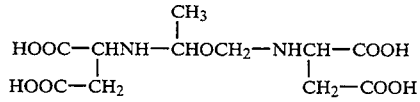
C-13
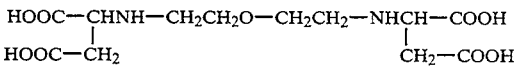
C-14
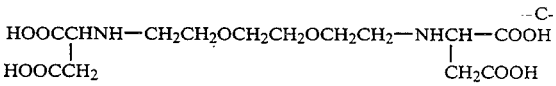
C-15
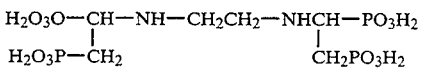
C-16
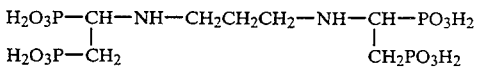
C-17
As for the ferric complexes of the above-given compounds (A-1) through (C-17), any one of the sodium salts, potassium salts or ammonium salts of these ferric complexes may be used arbitrarily.

Among the above-given examples of the compounds, the compounds applicable to the invention include desirably (A-1), (A-3), (A-4), (A-5), (A-9), (A-10), A-11), (B-1), (B-2), (B-6), (C-1), (C-3) and (C-14) and, particularly, (A-1) and (B-2).

The compounds represented by the foregoing Formulas A through C can be synthesized in any ordinary methods such as described in JP OPI Publication Nos. 63-267750/1988, 63-267751/1988, 2-115172/1990 and 2-295954/1990.

The ferric complexes of organic acids may be added in an amount within the range of, desirably, 0.1 mols to 2.0 mols and, more desirably, 0.15 to 1.5 mols, each per liter of a bleaching solution used.

In the bleaching solution or a bleach-fixing solution, the desirable bleaching agents other than the ferric complexes of the compounds represented by the foregoing Formulas A through C include the compounds described in JP Application No. 2-302784/1990, the 1st line on p. 79 through the 20th line on p. 80.

When making combination use of two or more kinds of ferric complexes of organic acids, it is desired, from the viewpoint of displaying more excellent effects of the invention, that the ferric complexes of the compounds represented by the foregoing Formulas A through C occupy a proportion of, desirably, not less than 70% (in mol terms), more desirably, not less than 80%, further desirably, not less than 90% and, most desirably, not less than 95%.

An effect on rapid bleaching, bleach-fixing and/or fixing treatments can be displayed when a bleaching solution, a bleach-fixing solution and a fixing solution contain each at least either one of imidazole and the derivatives thereof described in JP OPI Publication No. 64-295258/1989 or at least either one of the compounds represented by Formulas I through IX given in the same JP OPI Publication and the exemplified compounds thereof.

Besides the above-mentioned accelerators, the exemplified compounds given in JP OPI Publication No. 62-123459/1987, pp. 51–115; the exemplified compounds given in JP OPI Publication No. 63-17445/1988, pp. 22–25; the compounds given in JP OPI Publication Nos. 53-95630/1978 and 53-28426/1978; and so forth may similarly be used.

These accelerators can be used independently or in combination. They may be generally used in an amount within the range of, desirably, about 0.01 to 100 g, more desirably, 0.05 to 50 g and, particularly, 0.05 to 15 g, each per liter of a bleaching solution used. The temperature of the bleaching solution or bleach-fixing solution may be within the range of, desirably, 20° C. to 50° C. and, more desirably, 25° C. to 45° C. The pH of the bleaching solution is, desirably, not higher than 6.0 and, more desirably, within the range of not lower than 1.0 to not higher than 5.5. The pH of the bleach-fixing solution is within the range of, desirably, 5.0 to 9.0 and, more desirably, 6.0 to 8.5. The pH values of the bleaching solution or the bleach-fixing solution means the pH of a processing tank in the course of processing a silver halide light sensitive material, and the pH thereof is to be clearly distinguishable from the pH values of so-called replenishers.

Besides the above, any known compounds may be contained in the bleaching solution or the bleach-fixing solution.

The bleaching solution or the bleach-fixing solution may be replenished in an amount of, desirably, not more than 500 ml, more desirably, within the range of 20 ml to 400 ml and, most desirably, 40 ml to 300 ml, each per $m^2$ of a silver halide color photographic light sensitive material to be processed. The less they are replenished, the more the effects of the invention can be displayed.

For the purpose of enhancing the activity of the bleaching solution or the bleach-fixing solution in the invention, the air or oxygen is allowed to be blown in a processing bath and a replenisher reservoir tank, if required. Or, a suitable oxidizer such as hydrogen peroxide, a bromate and persulfate is also allowed to be added.

As for the fixing agents applicable to fixing solutions or bleach-fixing solutions, any known fixing agents may be used. They include, desirably, a thiocyanate and a thiosulfate.

It is desired that thiocyanate is to be contained in an amount of at least not less than 0.1 mols per liter and, in the case that a color negative film is processed, the contents thereof is to be in an amount of, desirably, not less than 0.3 mols per liter and, more desirably, not less than 0.5 mols per liter. The contents of thiosulfate are to be in an amount of, desirably, at least not less than 0.2 mols per liter and, in the case that a color negative film is processed, the contents thereof are to be in an amount of, desirably, not less than 0.5 mols per liter.

Besides the above-mentioned fixing agents, the fixing solutions or the bleach-fixing solutions are allowed to contain any known pH buffers independently or in combination.

It is also desired that a large amount of a rehalogenating agent including, for example, alkali halide or ammonium halide such as potassium bromide, sodium bromide, sodium chloride and ammonium bromide. It is further allowed to suitably add the compounds such as alkyl amines or polyethylene oxides which have been known to be added to any ordinary fixing solutions or bleach-fixing solutions.

It is also allowed to recover silver from the fixing solutions or the bleach-fixing solutions, in any know methods.

The fixing solutions may be usually replenished in an amount within the range of 50 ml to 900 ml and, desirably, 100 ml to 500 ml, each per $m^2$ of a light sensitive material to be processed.

The pH of the fixing solution is desirably within the range of 4 to 8.

It is desired to add the compounds represented by the following Formula FA and the exemplified compounds thereof given in JP OPI Publication No. 64-295258/1989. When this is the case, not only the effects of the invention can be more excellently displayed, but also another effect can be displayed so as to extremely reduce any sludges which may be produced in a processing solution having a fixing function, when processing a small quantity of light sensitive materials for a long period of time.

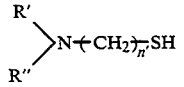

Formula FA

The compounds represented by Formula FA given in the same patent specification can be synthesized in any ordinary method such as described in U.S. Pat. Nos.

3,335,161 and 3,260,718. The compounds represented by Formula FA may be used independently or in combination.

The compounds represented by Formula FA may be added in an amount within the range of 0.1 g to 200 g per liter of a processing solution used, so that an excellent result can be enjoyed.

Any desired processing time may be taken when making use of the bleaching solution and fixings solutions relating to the invention. It is, however, taken for, desirably, not longer than 3 minutes 30 seconds, more desirably, within the range of 10 seconds to 2 minutes 20 seconds and, particularly, 20 seconds to 1 minute 20 seconds. When making use of the bleach-fixing solutions, the processing time thereof is to take, desirably, not longer than 4 minutes and, more desirably, within the range of 10 seconds to 2 minutes 20 seconds.

In the processing procedures of the invention, the preferred embodiments of the invention are to forcibly stir a bleaching solution, a bleach-fixing solution or a fixing solution. The reasons thereof are not only that the effects of the objects of the invention can be more excellently displayed, but also from the viewpoint of a rapid processing aptitude. The expression, 'a forcible solution stirring', stated herein does not mean any ordinary diffusion or movement of the solution, but means that a forcible stirring is applied by attaching a stirring means. As for the forcible stirring means, those described in JP OPI Publication Nos. 64-222259/1989 and 1-206343/1989 may be adopted.

In the invention, a cross-over time between a color developing tank and a bleaching tank or a bleach-fixing tank is desirably within 10 seconds and, more desirably, within 7 seconds. When this is the case, the other effects than those of the invention, i.e., the effects against any bleach-fog production, can be displayed.

The processing solutions applicable to the processing methods of the invention have been detailed as above. Besides the above, it is also allowed to contain the following additives into the processing solutions.

The bleaching solutions are also allowed to contain the ordinary additives such as a bleaching agent, a pH controller; an acid and the additives of the acid and a bleaching accelerator each given in JP OPI Publication No. 2-44347/1990, pp. (3)-(4) and JP OPI Publication No. 2-43546/1990, pp. (37)-(38). The fixing solutions are also allowed to contain the ordinary additives such as a fixing agent, a fixing accelerator, a preservative and a chelating agent each given in JP OPI Publication No. 2-44347/1990, p.(4). The bleach-fixing solutions are also allowed to contain those given in JP OPI Publication No. 2-43546/1990, pp.(37)-(38). Further, the stabilizers relating to the invention are also allowed to contain a pasteurizer, antimold, a chelating agent, a fluorescent whitening agent and so forth such as those given in JP OPI Publication No. 2-43546/1990, pp.(38)-(39).

In the silver halide color photographic light sensitive materials applicable to the invention, the silver halide emulsions described in Research Disclosure 308119 (hereinafter abbreviated to as RD308119) may be used. The places described of the emulsions will be given below.

| Item | Pages of RD308119 |
|---|---|
| Iodine composition | 993 I-A |
| Preparation procedures | 993 I-A & 994 E |
| Crystal habit, Regular | 993 I-A |

-continued

| Item | Pages of RD308119 |
|---|---|
| Twinned | " |
| Epitaxial | " |
| Halogen composition, | |
| Uniformed | 993 I-B |
| Not uniformed | " |
| Halogen conversion | 994 I-C |
| Halogen substitution | " |
| Metal content | 994 I-D |
| Monodispersion | 995 I-F |
| Solvent addition | " |
| Latent image formed position, | |
| Surface | 995 I-G |
| Inside | " |
| Light sensitive material applied, | |
| Negative | 995 I-H |
| Positive (containing inside fogged grains) | " |
| Used by mixing emulsions | 995 I-J |
| Demineralization | 995 II-A |

In the invention, an emulsion is used after it was physically and chemically ripened and then spectrally sensitized. The additives used in the above-mentioned steps are described in Research Disclosure Nos. 17643, 18716 and 308119 (hereinafter abbreviated to as RD 17643, RD18716 and RD308119).

The places described thereof will be given below.

| Item | Page of RD308119 | RD17643 | RD18716 |
|---|---|---|---|
| Chemical sensitizer | 996 IIIA | 23 | 648 |
| Spectral sensitizer | 996 IV-A-A,B,C, D,E,H,I,J | 23-24 | 648-9 |
| Supersensitizer | 996 IV-A-E, J | 23-24 | 648-9 |
| Antifoggant | 998 VI | 24-25 | 649 |
| Stabilizer | 998 VI | 24-25 | 649 |

The known photographic additives applicable to the invention are also described in the above-given Research Disclosures. The places thereof will be given in the following table.

| Item | Page of RD308119 | RD17643 | RD18716 |
|---|---|---|---|
| Color-stain inhibitor | 1002 VIII | 25 | 650 |
| Dye-image stabilizer | 1001 VIII | 25 | |
| whitening agent | 998 V | 24 | |
| UV absorbent | 1003 VIII C, XIII C | 25-26 | |
| Light absorbent | 1003 VIII | 25-26 | |
| Light scattering agent | 1003 VIII | | |
| Filter dye | 1003 VIII | 25-26 | |
| Binder | 1003 IX | 26 | 651 |
| Antistatic agent | 1006 XIII | 27 | 650 |
| Layer hardener | 1004 X | 26 | 651 |
| Plasticizer | 1006 XII | 27 | 650 |
| Lubricant | 1006 XII | 27 | 650 |
| Activator-Coating aid | 1005 XI | 26-27 | 650 |
| Matting agent | 1007 XVI | | |
| Developing agent, (contained in a light sensitive material) | 1011 XX-B | | |

The light sensitive materials applicable to the invention can be used with various kinds of couplers. The typical examples thereof are given in the above-mentioned Research Disclosures. The places thereof will be given in the following table.

| Item | Page of RD308119 | RD17643 RD18716 |
|---|---|---|
| Yellow coupler | 1001 VII-D | VII C-G |
| Magenta coupler | 1001 VII-D | VII C-G |
| Cyan coupler | 1001 VII-D | VII C-G |
| DIR coupler | 1001 VII-F | VII F |
| BAR coupler | 1002 VII-F | |
| Other useful residual-group releasing coupler | 1001 VII-F | |
| Alkali-soluble coupler | 1001 VII-E | |

The additives applicable to the invention may be added in the dispersion method described in RD308119 XIV and so forth.

In the invention, the supports described in the foregoing RD17643, p. 28, RD18716, pp. 647–8, and RD308119, XIX may be used.

Light sensitive materials may be provided with the auxiliary layers such as a filter layer and an interlayer described in the foregoing RD308119, VII-K. The light sensitive materials may have various layer arrangements including, for example, a regular layer arrangement, an inverse layer arrangement and a unit arrangement each of which is described in the foregoing RD308119, VII-K.

When making use of a vinyl sulfone type layer hardener in a light sensitive material in the invention, the effects of the invention can be more excellently displayed.

The above-mentioned vinyl sulfone type layer hardeners are each a compound having a vinyl group coupled to a sulfonyl group, or a compound having a group capable of forming a vinyl group. Among them, the desirable layer hardeners include those having either at least two vinyl groups each coupled to sulfonyl groups, or at least two groups capable of forming a vinyl group. For example, the compounds represented by the following Formula VS-1 may desirably be used.

Formula VS-1

$$L—(SO_2\text{-}X)_m$$

wherein L represents an m-valent linkage group; X represents $—CH{=}CH_2$ or $—CH_2CH_2Y$ in which Y represents a group capable of splitting off in the form of HY, such as a halogen atom, a sulfonyloxy group, a sulfoxy group (including the salts thereof), a tertiary amine residual group or the like;

m is an integer of 2 to 10, provided, when m is not less than 2, $—SO_2—X$ may be the same with or the different from each other;

m-valent linkage group L is an m-valent group formed by one or plurally combined linkage represented by an aliphatic hydrocarbon group (such as an alkylene group, an alkylidene group, an alkylidine group or a group formed by linking thereto) an aromatic hydrocarbon group (such as an arylene group or a group formed by linking thereto), —O—, —NR′— (in which R′ represents a hydrogen atom or, desirably, an alkyl group having 1 to 15 carbon atoms), —S—, —N<, —CO—, —SO—, $—SO_2—$ or $—SO_3—$. When containing two or more NR′, each of R's may be linked so as to form a ring. Linkage groups L further include those having a substituent such as a hydroxy group, an alkoxy group, a carbamoyl group, a sulfamoyl group, an alkyl group or an aryl group.

The typical examples of X include, desirably, $—CH{=}CH_2$, $—CH_2CH_2Cl$ and so forth.

The typical and concrete examples of the vinyl sulfone type layer hardeners will be given below.

$$H_2C{=}CHSO_2CH_2\underset{\underset{OH}{|}}{C}HCH_2SO_2CH{=}CH_2 \qquad \text{VS-6}$$

$$H_2C{=}CHSO_2CH_2CONH(CH_2)_2NHCOCH_2SO_2CH{=}CH_2 \qquad \text{VS-9}$$

$$H_2C{=}CHSO_2CH_2CONHCH_2CH_2CH_2NHCOCH_2SO_2CH{=}CH_2 \qquad \text{VS-10}$$

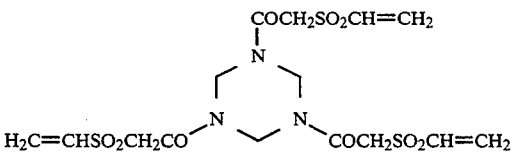

VS-12

$$(H_2C{=}CHSO_2CH_2)_4C \qquad \text{VS-22}$$

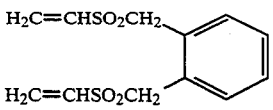

VS-33

$$H_2C{=}CHSO_2CH_2C(CH_2SO_2CH_2CH_2OSO_3{}^{\ominus}Na^{\oplus})_3 \qquad \text{VS-54}$$

The other typical and concrete exemplified compounds include (VS-1), (VS-3), (VS-5), (VS-7), (VS-8), (VS-11), (VS-13)–(VS-21), (VS-23)–(VS-32), (VS-34)–(VS-53) and (VS-55)–(VS-57) each given in JP Application No. 2-274026/1990, pp. 122–128.

The vinyl sulfone type layer hardeners applicable to the invention include, for example, an aromatic compounds such as those described in German Patent No. 1,100,942 and U.S. Pat. No. 3,490,911; alkyl compounds coupled each with a hetero atom such as those described in JP Examined Publication Nos. 44-29622/1969, 47-25373/1972 and 47-24259/1972; sulfonamide or ester type compounds such as those described in JP Examined Publication No. 47-8736/1972; 1,3,5-tris[β-(vinylsulfonyl)-propionyl]-hexahydro-s-triazine or alkyl type compounds such as those described in JP Examined Publication No. 50-35807/1975 and JP OPI Publication No. 51-44164/1976; and the compounds described in JP OPI Publication No. 59-18944/1984.

These vinyl sulfone type layer hardeners are dissolved in water or an organic solvent and are then used in an amount within the range of 0.005 to 20% by weight and, desirably, 0.02 to 10% by weight to a binder(such as gelatin) used therein. They are added to a photographic layer in a batch system, an in-line adding system or the like. There is no special limitation to the photographic layers to which these layer hardeners are added, but these layer hardeners may also be added to, for example, the single uppermost layer, the single lowermost layer or the whole layer.

In the invention, when containing at least one kind of the compounds represented by the foregoing Formulas B-1 through B-3, the effects of the invention can be more excellently displayed.

The compounds represented by Formulas B-1 through B-3 may be used in an amount within the range of 0.1 to 500 mg and, desirably, 0.5 to 100 mg, each per $m^2$ of a light sensitive material used. The compounds represented by Formulas B-1 through B-3 may be used independently or in combination.

This invention can be applied to a color paper, a color negative film, a color reversal film, a color reversal paper, a direct positive color paper and a cinematographic color film each for general or cinematographic use, and a color photographic light sensitive material such as a TV color film.

EXAMPLE

Next, the invention will be concretely detailed with reference to the examples thereof. However, the invention shall not be limited thereto.

Example 1

The following stabilizer was prepared.

| | |
|---|---|
| 1,2-benzoisothiazoline-3-one | 0.05 g |
| Surfactant (Exemplified compound SII-5) | 3.0 g |
| Exemplified compound (See Table 1) | (See Table 1) |
| Fixing solution (*1) | 20 ml |
| Add water to make | 1 liter |
| Adjust pH to be | pH 8.0 |

After adjusting the pH of the resulting stabilizer, it was stored in a 1 liter beaker having a mouth of 10 $cm^2$ at 30° C. and the numbers of days until the precipitations were produced by a sulfurization were evaluated. The results thereof will be shown in Table 1.

(*1) The composition of the fixing solution was as follows.

| | |
|---|---|
| Ammonium thiosulfate | 120 g |
| Ammonium sulfite | 5 g |
| Silver iodide | 7 g |
| Add water to make | 1 liter |
| Adjust pH with ammonium hydroxide or glacial acetic acid to be | pH 7.0 |

TABLE 1

| Stabilizer No. | Additive (Amt added per liter) | Solution preservability (days until sulfurized) | Remarks |
|---|---|---|---|
| 1-1 | — | 14 days | Comparison |
| 1-2 | Formaldehyde (35%)(0.6 ml) | 1 day | Comparison |
| 1-3 | Formaldehyde (35%)(4.0 ml) | <1 day | Comparison |
| 1-4 | Hexaniethylenetetramine (2.0 g) | 4 days | Comparison |
| 1-5 | Dimethylol urea (2.0 g) | 3 days | Comparison |
| 1-6 | Acetaldehyde (2.0 g) | 3 days | Comparison |
| 1-7 | Exemplified compound (I-1)(2.0 g) | 12 days | Invention |
| 1-8 | Exemplified compound (I-2)(2.0 g) | 11 days | Invention |
| 1-9 | Exemplified compound (I-3) (2.0 g) | 11 days | Invention |
| 1-10 | Exemplified compound (I-6)(2.0 g) | 10 days | Invention |
| 1-11 | Exemplified compound (I-8)(2.0 g) | 11 days | Invention |
| 1-12 | Exemplified compound (I-11)(2.0 g) | 10 days | Invention |
| 1-13 | Exemplified compound (I-12)(2.0 g) | 10 days | Invention |
| 1-14 | Exemplified compound (I-15)(2.0 g) | 11 days | Invention |
| 1-15 | Exemplified compound (I-19)(2.0 g) | 10 days | Invention |
| 1-16 | Exemplified compound (I-24)(2.0 g) | 11 days | Invention |
| 1-17 | Exemplified compound (I-27)(2.0 g) | 11 days | Invention |
| 1-18 | Exemplified compound (I-29)(2.0 g) | 7 days | Invention |
| 1-19 | Exemplified compound (I-31)(2.0 g) | 8 days | Invention |
| 1-20 | Exemplified compound (I-32)(2.0 g) | 10 days | Invention |

As is obvious from Table 1, stabilizers 1-2 and 1-3 each added by formaldehyde were seriously deteriorated in solution preservability, and stabilizers 1-4 through 1-6 were also deteriorated in solution preservability.

In contrast to the above, every one of stabilizers 1-7 through 1-20 each applied with the compounds of the invention was excellent in solution preservability.

Example 2

In this example, the amounts of the materials added to the subject silver halide photographic light sensitive materials are indicated by grams per sq. meter, unless otherwise expressly stated. And, the amounts of silver halides and colloidal silver are indicated by converting them into the silver contents.

Multilayered color photographic light sensitive material Sample 1 was prepared by forming each of the layers having the following compositions on a triacetyl cellulose film support, in the order from the support side.

| Sample 1 | |
|---|---|
| Layer 1 : An antihalation layer | |
| Black colloidal silver | 0.18 |
| UV absorbent (UV-l) | 0.20 |
| Colored coupler (CC-1) | 0.05 |
| Colored coupler (CM-2) | 0.06 |
| High boiling solvent (Oil-1) | 0.20 |
| Gelatin | 1.5 |
| Layer 2 : An interlayer | |
| UV absorbent (UV-l) | 0.01 |
| High boiling solvent (Oil-1) | 0.01 |
| Gelatin | 1.2 |
| Layer 3 : A low-speed red-sensitive emulsion layer | |
| Silver iodobromide emulsion (Em-1) | 0.9 |
| Silver iodobromide emulsion (Em-2) | 0.6 |

-continued

| Sample 1 | |
|---|---|
| Sensitizing dye (S-1) | $2.2 \times 10^{-4}$ (mols/mol of Ag) |
| Sensitizing dye (S-2) | $2.5 \times 10^{-4}$ (mols/mol of Ag) |
| Sensitizing dye (S-3) | $0.5 \times 10^{-4}$ (mols/mol of Ag) |
| Cyan coupler (C-4') | 1.2 |
| Cyan coupler (C-2') | 0.3 |
| Colored cyan coupler (CC-1) | 0.05 |
| DIR compound (D-1) | 0.002 |
| High boiling solvent (Oil-1) | 0.5 |
| Gelatin | 1.2 |
| Layer 4 : A high-speed red-sensitive emulsion layer | |
| Silver iodobromide emulsion (EM-3) | 2.0 |
| Sensitizing dye (S-1) | $2.2 \times 10^{-4}$ (mols/mol of Ag) |
| Sensitizing dye (S-2) | $2.0 \times 10^{-4}$ (mols/mol of Ag) |
| Sensitizing dye (S-3) | $0.1 \times 10^{-4}$ (mols/mol of Ag) |
| Cyan coupler (C-1') | 0.20 |
| Cyan coupler (C-2') | 0.03 |
| Cyan coupler (C-3') | 1.15 |
| Colored cyan coupler (CC-1) | 0.015 |
| DIR compound (D-2) | 0.05 |
| High boiling solvent (Oil-1) | 0.5 |
| Gelatin | 1.3 |
| Layer 5 : An interlayer | |
| Gelatin | 0.5 |
| Layer 6 : A low-speed green-sensitive emulsion layer | |
| Silver iodobromide emulsion (Em-1) | 1.1 |
| Sensitizing dye (S-4) | $5 \times 10^{-4}$ (mols/mol of Ag) |
| Sensitizing dye (S-5) | $2 \times 10^{-4}$ (mols/mol of Ag) |
| Magenta coupler (M-1) | 0.45 |
| Colored magenta coupler (CM-1) | 0.05 |
| DIR compound (D-3) | 0.015 |
| DIR compound (D-4) | 0.020 |
| High boiling solvent (Oil-2) | 0.5 |
| Gelatin | 1.0 |
| Layer 7 : An interlayer | |
| Gelatin | 0.9 |
| High boiling solvent (Oil-1) | 0.2 |
| Layer 8 : A high-speed green-sensitive emulsion layer | |
| Silver iodobromide emulsion (Em-3) | 1.2 |
| Sensitizing dye (S-6) | $1.5 \times 10^{-4}$ (mols/mol of Ag) |
| Sensitizing dye (S-7) | $2.5 \times 10^{-4}$ (mols/mol of Ag) |
| Sensitizing dye (S-8) | $0.7 \times 10^{-4}$ (mols/mol of Ag) |
| Magenta coupler (M-2) | 0.08 |
| Magenta coupler (M-3) | 0.18 |
| Colored magenta coupler (CM-2) | 0.05 |
| DIR compound (D-3) | 0.01 |
| High boiling solvent (Oil-3) | 0.5 |
| Gelatin | 1.3 |
| Layer 9 : A yellow filter layer | |
| Yellow colloidal silver | 0.12 |
| Color-stain inhibitor (SC-1) | 0.1 |
| High boiling solvent (Oil-3) | 0.1 |
| Gelatin | 0.8 |
| Layer 10: A low-speed blue-sensitive emulsion layer | |
| Silver iodobromide emulsion (Em-1) | 0.30 |
| Silver iodobromide emulsion (Em-2) | 0.25 |
| Sensitizing dye (S-10) | $7 \times 10^{-4}$ (mols/mol of Ag) |
| Yellow coupler (Y-1) | 0.6 |
| Yellow coupler (Y-2) | 0.2 |
| DIR compound (D-2) | 0.01 |
| High boiling solvent (Oil-3) | 0.15 |
| Gelatin | 1.2 |
| Layer 11: A high-speed blue-sensitive emulsion layer | |
| Silver iodobromide emulsion (Em-4) | 0.50 |
| Silver iodobromide emulsion (Em-1) | 0.22 |
| Sensitizing dye (S-9) | $1.3 \times 10^{-4}$ (mols/mol of Ag) |
| Sensitizing dye (S-10) | $3 \times 10^{-4}$ (mols/mol of Ag) |
| Yellow coupler (Y-1) | 0.36 |
| Yellow coupler (Y-2) | 0.12 |
| High boiling solvent (Oil-3) | 0.07 |
| Gelatin | 1.2 |
| Layer 12: Protective layer 1 | |
| Finely grained silver iodobromide emulsion, (having an average grain size of 0.08 μm and an AgI content of 2.5 mol %) | 0.40 |
| UV absorbent (UV-1) | 0.10 |
| UV absorbent (UV-2) | 0.05 |
| High boiling solvent (Oil-1) | 0.1 |
| High boiling solvent (Oil-4) | 0.1 |

-continued

| Sample 1 | |
|---|---|
| Formalin scavenger (HS-1) | 0.5 |
| Formalin scavenger (HS-2) | 0.2 |
| Gelatin | 1.2 |
| Layer 13: Protective layer 2 | |
| Surfactant (Su-1) | 0.005 |
| Alkali-soluble matting agent, (having an average particle size of 2 μm) | 0.10 |
| Cyan dye (AIC-1) | 0.01 |
| Magenta dye (AIM-1) | 0.01 |
| Sliding agent (WAX-1) | 0.04 |
| Gelatin | 0.7 |

Besides the above-given compositions, each of the layers was added by coating aid Su-2, dispersing aid Su-3, antiseptic DI-1, stabilizer Stab-1 and antifoggants AF-1 and AF-2.

Em-1: A monodispersive, surface low-silver-iodide containing type emulsion having an average grain size of 0.46 μm and an average silver iodide content of 7.0 mol %;

Em-2 : A monodispersive, uniformly composed emulsion having an average grain size of 0.32 μm and an average silver .iodide content of 2.5 mol %;

Em-3: A monodispersive, surface low silver iodide containing type emulsion having an average grain size of 0.78 μm and an average silver iodide content of 6.0 mol %; and Em-4: A monodispersive, surface low silver iodide containing type emulsion having an average grain size of 0.95 μm and an average silver iodide content of 7.5 mol %

Em-1, Em-3 and Em-4 were each an silver iodobromide emulsion principally comprising octahedrons and having a multilayered structure, which were prepared with reference to JP OPI Publication Nos. 60-138538/1985 and 61-245151/1986. Either one of Em-1 through Em-4 has an average value of the grain sizes/grain thicknesses of 1.0 and their grain distributions were 14%, 10%, 12% and 12%, respectively.

S-1

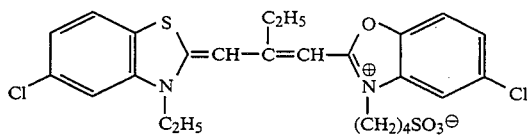

S-2

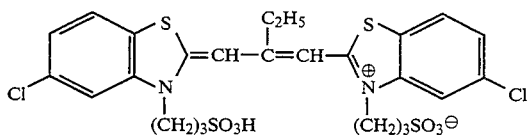

S-3

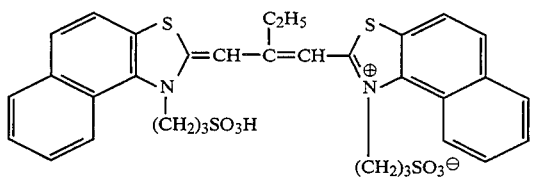

S-4

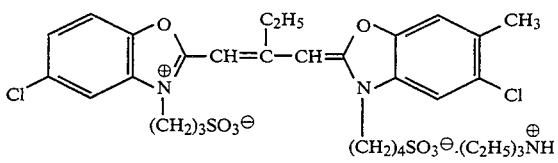

S-5

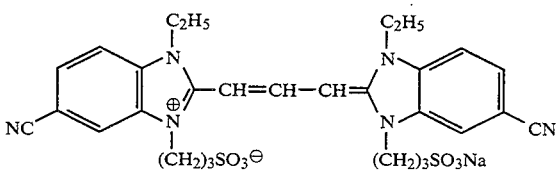

-continued
S-6
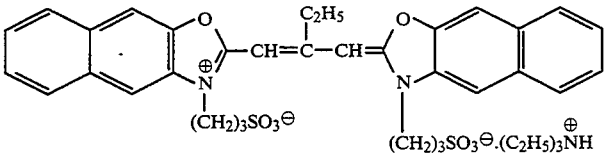
S-7
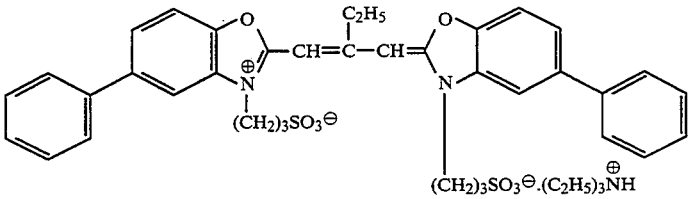
S-8
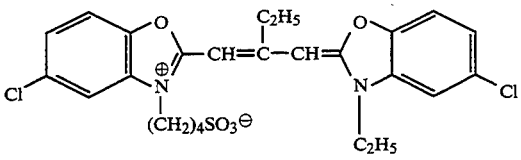
S-9
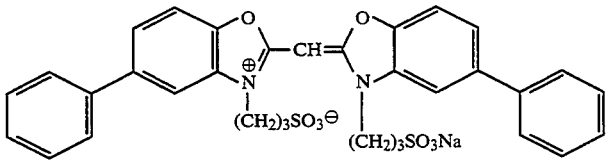
S-10
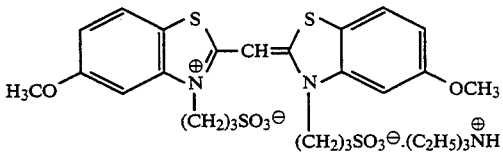
C-1′
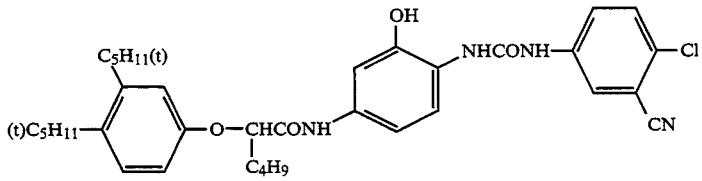
C-2′
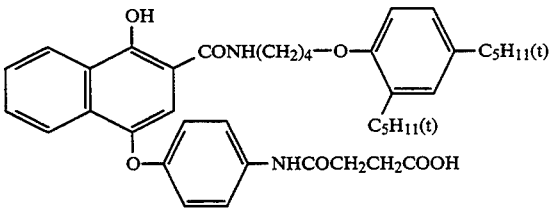
C-3′
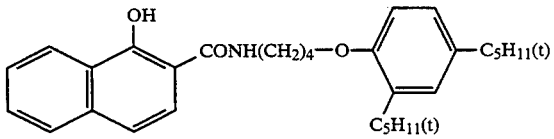

-continued
C-4'
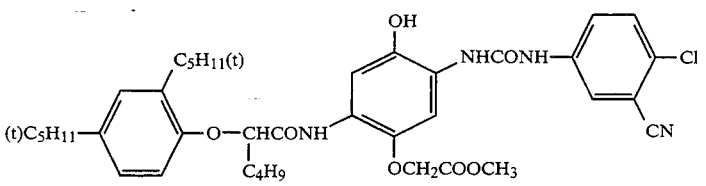
M-1
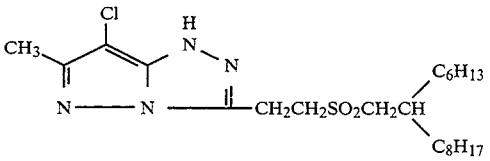
CC-1
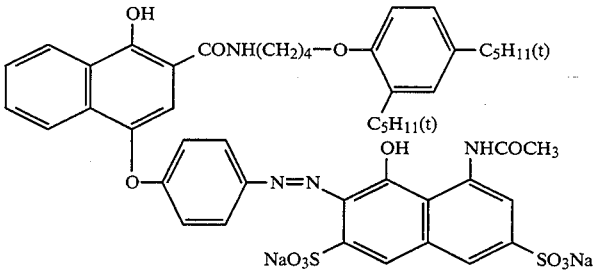
CM-1
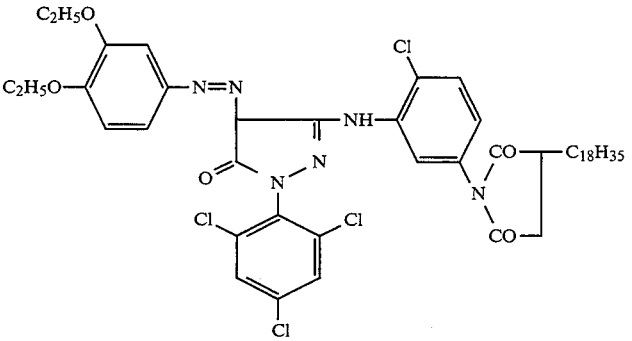
CM-2
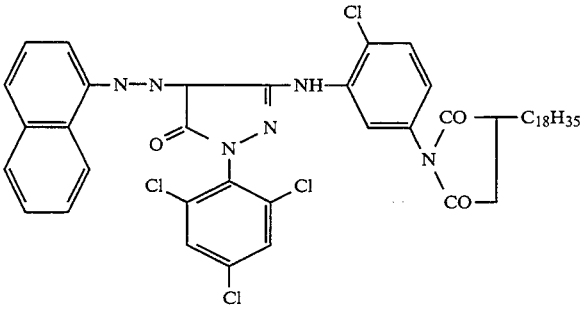

-continued
D-1
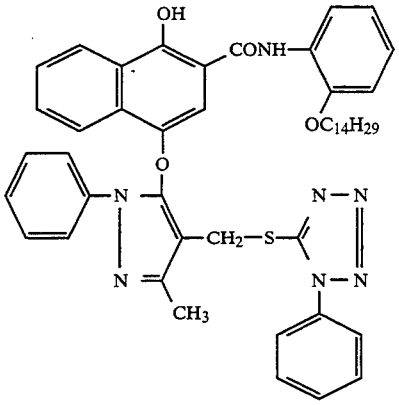
D-2
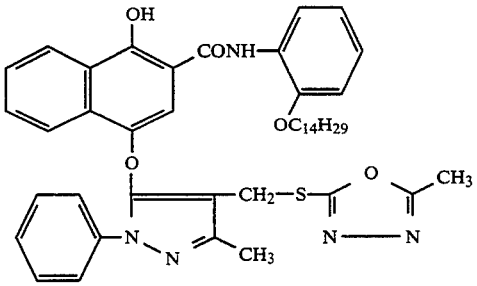
D-3
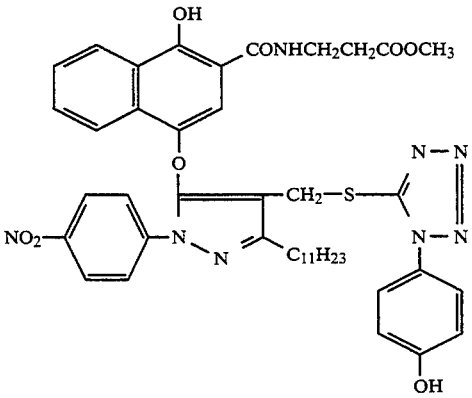
D-4
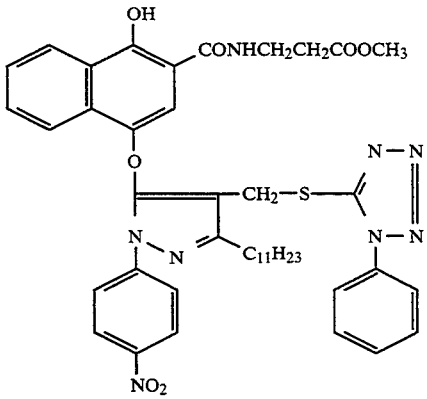
UV-1
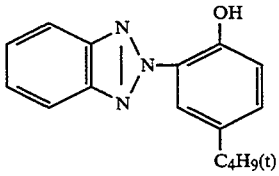

-continued
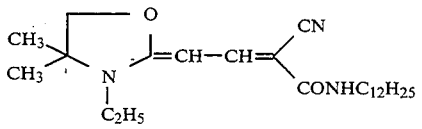
UV-2
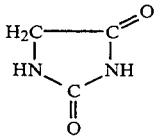
HS-1
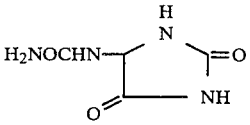
HS-2
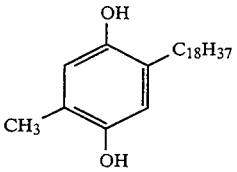
Sc-1
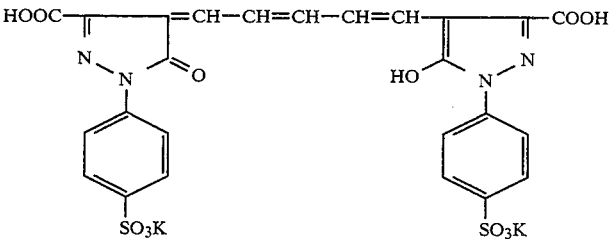
AIC-1
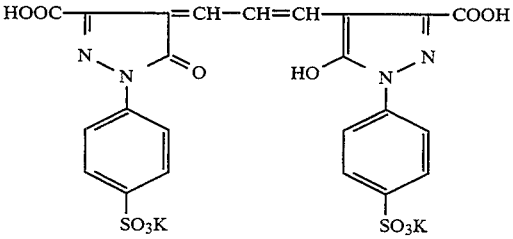
AIM-1
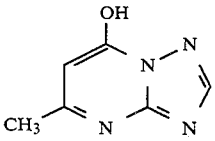
Stab-1
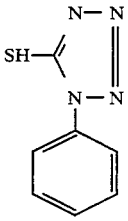
AF-1
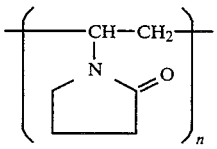
AF-2

-continued

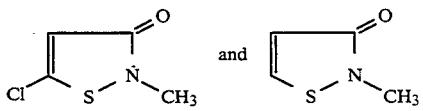

DI-1

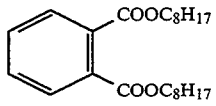

Oil-1

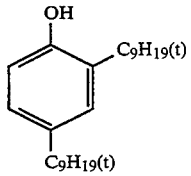

Oil-2

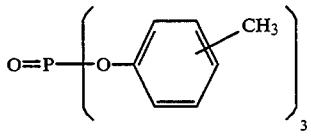

Oil-3

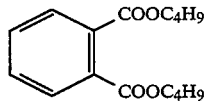

Oil-4

The resulting film samples were practically exposed to light by making use of a camera and were then subjected to the running tests under the following conditions.

| Processing step | Processing time | Processing temperature | Replenished Amount |
|---|---|---|---|
| Color developing | 3 min. 15 sec | 38° C. | 775 ml |
| Bleaching | 45 sec | 38° C. | 155 ml |
| Fixing | 1 min. 30 sec | 38° C. | 500 ml |
| Stabilizing | 50 sec | 38° C. | 775 ml |
| Drying | 1 min. | 40~70° C. | — |

(Replenished amounts were each a value per $m^2$ of a subject light sensitive material.)

In the processing steps, the stabilizing step was carried out in a double-tank counter-current system wherein the replenishments were made to the final tank of the stabilizing solution and the overflows were flown into the tank precedent to the final tank.

| | |
|---|---|
| Color developing solution | |
| Potassium carbonate | 30 g |
| Sodium hydrogen carbonate | 2.5 g |
| Potassium sulfite | 3.0 g |
| Sodium bromide | 1.2 g |
| Potassium iodide | 0.6 mg |
| Hydroxylamine sulfate | 2.5 g |
| Sodium chloride | 0.6 g |
| 4-amino-3-methyl-N-ethyl-N-(β-hydroxylethyl)aniline sulfate | 4.6 g |
| Diethylenetriamine pentaacetic acid | 3.0 g |
| Potassium hydroxide | 1.2 g |
| Add water to make | 1 liter |
| Adjust pH with potassium hydroxide or an aqueous 20% sulfuric acid solution to be | pH 10.01 |
| Color developing replenisher | |
| Potassium carbonate | 40 g |
| Sodium hydrogen carbonate | 3 g |
| Potassium sulfite | 7 g |
| Sodium bromide | 0.5 g |

-continued

| | |
|---|---|
| Hydroxylamine sulfate | 3.1 g |
| 4-amino-3-methyl-N-(β-hydroxylethyl)aniline sulfate | 6.0 g |
| Diethylenetriamine pentaacetic acid | 3.0 g |
| Potassium hydroxide | 2 g |
| Add water to make | 1 liter |
| Adjust pH with potassium hydroxide or an aqueous 20% sulfuric acid solution to be | pH 10.12 |
| Bleaching solution | |
| Ferric ammonium 1,3-propylene diamine tetraacetate | 0.32 mols |
| Disodium ethylenediamine tetraacetate | 10 g |
| Ammonium bromide | 100 g |
| Glacial acetic acid | 40 g |
| Ammonium nitrate | 40 g |
| Add water to make | 1 liter |
| Adjust pH with aqueous ammonia or glacial acetic acid to be | pH 4.4 |
| Bleaching replenisher | |
| Ferric ammonium 1,3-propylene diamine tetraacetate | 0.35 mols |
| Disodium ethylenediamine tetraacetate | 2 g |
| Ammonium bromide | 120 g |
| Ammonium nitrate | 50 g |
| Glacial acetic acid | 40 g |
| Add water to make | 1 liter |
| Adjust pH with aqueous ammonia or glacial acetic acid to be | pH 3.4 |
| Fixing solution and Fixing replenisher | |
| Ammonium thiosulfate | 200 g |
| Sodium bisulfite anhydrous | 20 g |
| Sodium metabisulfite | 4.0 g |
| Disodium ethylenediamine tetraacetate | 1.0 g |
| Urea | 1.0 g |
| Add water to make | 1 liter |
| Adjust pH with glacial acetic acid or aqueous ammonia to be | pH 6.5 |
| Stabilizing solution and Stabilizing replenisher | |

Stabilizing solution and Stabilizing replenisher
The same stabilizer as in Example 1 was used.

The running processes were carried out through an automatic processor, until the stabilizing replenisher was replenished three times as much as the capacity of the stabilizing tank.

After completing the running processes, the maximum magenta density portions of each processed film sample were measured and, next, the samples were then stored for two weeks in the state of 20% RH. After storing them, the maximum magenta densities of the samples were measured and the dye discoloration ratios thereof were obtained.

After the samples were further stored in the state of 75° C. and 60% RH, the yellow densities thereof in the unexposed portions were measured, so that the yellow stains were checked up. After completing the running processes, the scratches produced on the rear sides of the film samples were observed.

The stabilizing solution of 1 liter in the 2nd stabilizing tank was put in a beaker having a mount of 50 $cm^2$ and was then stored at 25° C. therein. After that, the stability of the solution (or the numbers of days until the solution was sulfurized.) was evaluated.

The results thereof will be collectively given in Table 2.

TABLE 2

| Experiment No. | Additive (Amt added per liter) | Dye discoloration ratio (%) in storing at 75° C., 20% RH | Yellow stain in storing at 75° C., 60% RH | Scratch | Solution preservability (Days required for sulfurization) | Remarks |
|---|---|---|---|---|---|---|
| 2- 1 | — | 52 | 0.12 | XX | 15 days | Comparison |
| 2- 2 | Formaldehyde (35%)(0.6 ml) | 31 | 0.07 | ∘ | 2 days | Comparison |
| 2- 3 | Formaldehyde (35%)(7.0 ml) | 6.6 | 0.00 | ∘ | 1 day | Comparison |
| 2- 4 | Hexamethylene tetramine (2.5 g) | 30 | 0.10 | X | 4 days | Comparison |
| 2- 5 | Dimthylol urea (2.5 g) | 34 | 0.13 | XX | 3 days | Comparison |
| 2- 6 | Acetaldehyde (2.5 g) | 46 | 0.13 | X | 3 days | Comparison |
| 2- 7 | Salicylacetaldehyde (2.5 g) | 13.8 | 0.04 | ∘ | 8 days | Comparison |
| 2- 8 | Furfural (2.5 g) | 15.1 | 0.05 | X | 9 days | Comparison |
| 2- 9 | 1-hydroxybenzene-2, 4-dialdehyde (2.5 g) | 14.2 | 0.04 | ∘ | 7 days | Comparison |
| 2-10 | Exemplified compound (I-1)(2.5 g) | 6.6 | 0.00 | ∘ | 11 days | Invention |
| 2-11 | Exemplified compound (I-2)(2.5 g) | 8.1 | 0.02 | ∘ | 9 days | Invention |
| 2-12 | Exemplified compound (I-3)(2.5 g) | 9.2 | 0.02 | ∘ | 9 days | Invention |
| 2-13 | Exemplified compound (I-6) (2.5 g) | 7.8 | 0.02 | ∘ | 8 days | Invention |
| 2-14 | Exemplified compound (I-8) (2.5 g) | 9.0 | 0.02 | ∘ | 8 days | Invention |
| 2-15 | Exemplified compound (I-11) (2.5 g) | 8.4 | 0.02 | ∘ | 9 days | Invention |
| 2-16 | Exemplified compound (I-15)(2.5 g) | 6.8 | 0.00 | ∘ | 10 days | Invention |
| 2-17 | Exemplified compound (I-19)(2.5 g) | 6.9 | 0.01 | ∘ | 11 days | Invention |
| 2-18 | Exemplified compound (I-24)(2.5 g) | 7.0 | 0.01 | ∘ | 11 days | Invention |
| 2-19 | Exemplified compound (I-27)(2.5 g) | 6.8 | 0.01 | ∘ | 10 days | Invention |
| 2-20 | Exemplified compound (I-31)(2.5 g) | 10.0 | 0.02 | ∘ | 8 days | Invention |

In the above, O means that no scratch was produced; X means that some scratches were observed; and the more Xs are, the more the scratches were seriously produced.

As is obvious from the results shown in Table 2, when a large amount of formaldehyde were used, the solution preservability was seriously deteriorated, though the discoloration ratio and scratch production were not problematic. In the cases of Experiment Nos. 2-4 through 2-9 in which the conventional compounds substituted for formaldehyde, not only the image discoloration ratios were deteriorated, but also both of the scratch productions and the solution preservabilities were deteriorated.

Among the aromatic aldehyde compounds, it can be found that only those having a specific substituent in the meta position can be excellent: in all of discoloration ratio at a low temperature, yellow stain prevention at a high temperature, scratch prevention and solution preservability.

Example 3

The same experiments as in Example 2 were tried, except that the stabilizer used in Experiment No. 2-10 of Example 2 was replaced by the following one.

| Stabilizer | Amount added |
|---|---|
| Surfactant (See Table 3) | (See Table 3) |
| Additive | 2.0 g |
| Add water to make | 1 liter |
| Adjust pH with sodium hydroxide or a 50% sulfuric acid solution to be | pH 7.5 |

The discoloration ratio and the yellow stain production were measured in the same manner as in Example 2. The results thereof will be given collectively in Table 3.

TABLE 3

| Experiment No. | Surfactant (Amount added) | Additive | Discoloration ratio (%) | Yellow stain |
|---|---|---|---|---|
| 3- 1 | Not added | Exemplified compound (I-1) | 9.5 | 0.04 |
| 3- 2 | Not added | Not added | 54 | 0.13 |
| 3- 3 | Ethylene glycol (3 g/l) | Exemplified compound (I-1) | 9.6 | 0.04 |
| 3- 4 | Diethylene glycol (3 g/l) | Exemplified compound (I-1) | 9.9 | 0.05 |
| 3- 5 | Polyethylene glycol (3 g/l) | Exemplified compound (I-1) | 9.8 | 0.04 |
| 3- 6 | SI- 4 (3 g/l) | Exemplified compound (I-1) | 7.3 | 0.02 |
| 3- 7 | SI-14 (3 g/l) | Exemplified compound (I-1) | 8.1 | 0.02 |
| 3- 8 | SI-17 (3 g/l) | Exemplified compound (I-1) | 8.0 | 0.03 |
| 3- 9 | SII-1 (3 g/l) | Exemplified compound (I-1) | 6.5 | 0.01 |
| 3-10 | SII-5 (3 g/l) | Exemplified compound (I-1) | 6.8 | 0.00 |
| 3-11 | SII-12 (3 g/l) | Exemplified compound (I-1) | 6.7 | 0.00 |
| 3-12 | SII-18 (3 g/l) | Exemplified compound (I-1) | 6.4 | 0.01 |
| 3-13 | SII-40 (3 g/l) | Exemplified compound (I-1) | 7.0 | 0.01 |
| 3-14 | SII-72 (3 g/l) | Exemplified compound (I-1) | 7.1 | 0.01 |
| 3-15 | SU-I-1 (0.3 g/l) | Exemplified compound (I-1) | 6.5 | 0.00 |
| 3-16 | SU-I-3 (0.3 g/l) | Exemplified compound (I-1) | 6.4 | 0.00 |
| 3-17 | SU-I-5 (0.3 g/l) | Exemplified compound (I-1) | 6.4 | 0.01 |
| 3-18 | SU-I-20 (0.3 g/l) | Exemplified compound (I-1) | 6.0 | 0.00 |

As is obvious from Table 3, it can be proved that the discoloration ratio and yellow stain prevention can be excellent when making use of the surfactants used in Experiment Nos. (3-6) through (3-18) in the invention.

Example 4

The running experiments were tried in the same manner as in Example 2, except that the bleaching solution and fixing solution used in Example 2 were replaced by the following bleach-fixing solution and the following processing steps were carried out.

| Processing step | Processing time | Processing temperature | Amount replenished |
|---|---|---|---|
| Color developing | 3 min. 15 sec. | 38° C. | 775 ml |
| Bleach-fixing | 3 min.. | 38° C. | 650 ml |
| Stabilizing | 1 min. | 38° C. | 800 ml |
| Drying | 1 min. | 40~70° C. | — |

| Bleach-fixing solution & Bleach-fixing replenisher | |
|---|---|
| Ammonium thiosulfate | 240 g |
| Ferric ammonium diethylenetriamine pentaacetate | 150 g |
| Ammonium sulfite | 15 g |
| Thiourea | 2 g |
| 2-amino-5-mercapto-1,3,4-thiadiazole | 2 g |
| Add water to make | 1 liter |
| Adjust pH with acetic acid and aqueous ammonia to be | pH 7.0 |

The experiments were tried in the same manner as in Example 2, except that the film samples were also subjected to the experiments. The results thereof were almost the same as in Example 2.

Example 5

The experiments were tried under the same conditions as in Example 2, except that the bleaching solution and fixing solution each used in Example 2 were replaced by the following bleaching solution and bleach-fixing solution, the stabilizing process was carried out in a three-tank counter-current system in which the stabilizing replenishments were made to the final tank of the stabilizing tanks and the overflows were flowed into the tank precedent to the final stabilizing tank, and all the overflows of the bleaching solutions are flowed in a system in which they are flowed into the bleach-fixing solution of the tank following the tank overflowed therefrom. The results thereof were almost the safe as in Example 2.

| Bleaching solution & bleach-fixing solution | |
|---|---|
| Ferric ammonium ethylenediamine tetraacetate | 100 g |
| Ferric ammonium 1,3-propylenediamine tetraacetate | 50 g |
| Ammonium bromide | 100 g |
| Ammonium nitrate | 45 g |
| Bleach accelerator | 0.005 mols |

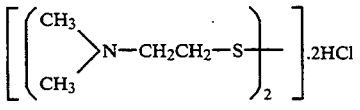

| | |
|---|---|
| Aqueous ammonia (27%) | 12 ml |
| Acetic acid | 5 g |
| Add water to make | 1 liter |
| Adjust pH with aqueous ammonia and acetic acid to be | pH 6.0 |

| Bleach-fixing solution and bleach-fixing replenisher | |
|---|---|
| Ferric ammonium ethylenediamine tetraacetate | 50 g |
| Ethylenediamine tetraacetic acid | 3 g |

-continued

| | |
|---|---|
| Ammonium sulfite | 12 g |
| Ammonium thiosulfate | 170 g |
| Ammonium thiocyanate | 70 g |
| Aqueous ammonia (27%) | 4.5 ml |
| Add water to make | 1 liter |
| Adjust pH with aqueous ammonia and acetic acid to be | pH 7.2 |

| Processing step | Processing time | Processing temperature | Amount replenished |
|---|---|---|---|
| Color developing | 2 min. 30 sec. | 40° C. | 610 ml |
| Bleaching | 1 min. | 38° C. | 460 ml |
| Bleach-fixing | 3 min. | 38° C. | 920 ml |
| Stabilizing | 1 min. | 35° C. | 800 ml |
| Drying | 1 min. | 40~70° C. | — |

(The amounts replenished were the values per sq. meter of a subject light sensitive material.)

Example 6

The following bleaching solution, bleaching replenisher, fixing solution and fixing replenisher were each prepared.

| | |
|---|---|
| Bleaching solution | |
| Ferric potassium 1,3-propylenediamine tetraacetate | 0.32 mols |
| Disodium ethylenediamine tetraacetate | 10 g |
| Potassium bromide | 100 g |
| Maleic acid | 30 g |
| Sodium nitrate | 40 g |
| Add water to make | 1 liter |
| Adjust pH to be | pH 4.4 |
| Bleaching replenisher | |
| Ferric potassium 1,3-propylenediamine tetraacetate | 0.35 mols |
| Disodium ethylenediamine tetraacetate | 2 g |
| Potassium bromide | 120 g |
| Sodium nitrate | 50 g |
| Maleic acid | 40 g |
| Sodium nitrate | 40 g |
| Add water to make | 1 liter |
| Adjust pH to be | pH 3.4 |
| Fixing solution & fixing replenisher | |
| Potassium thiocyanate | 120 g |
| Potassium thiosulfate | 200 g |
| Sodium bisulfite anhydrous | 20 g |
| Sodium metabisulfite | 4.0 g |
| Disodium ethylenediamine tetraacetate | 1.0 g |
| Add water to make | 1 liter |
| Adjust pH to be | pH 6.5 |
| Stabilizing solution & stabilizing replenisher | |

The same as those of Experiment Nos. 2-1 through 2-20 of Example 2.

When each of the evaluation was made in the same manner as in Example 2, almost the same results as in Example 2 were obtained and the surroundings were proved to be excellent without producing any smells of ammonia, acetic acid and so forth.

Besides the effects of the invention, the resulting bleach-fogs (or the transmission densities of B·G·R) were produced as few as of the order of 0.01 to 0.03 and the demineralization was also excellent.

Example 7

The same evaluation as in Example 2 was made by making use of the light sensitive material used in Example 2, provided, however, that the processing steps were carried out as follows.

| Processing step | Processing time | Processing temperature | Amount replenished |
|---|---|---|---|

-continued

| | | | |
|---|---|---|---|
| Color developing | 3 min. 15 sec. | 38° C. | 775 ml |
| Bleaching | 4 min. 20 sec. | 38° C. | 155 ml |
| Fixing | 4 min. 20 sec. | 38° C. | 500 ml |
| Washing | 3 min. 15 sec. | 18~42° C. | 75 ml |
| Stabilizing | 2 min. 10 sec. | 38° C. | 775 ml |
| Drying | 3 min.. | 40~70° C. | |

| | |
|---|---|
| Color developing solution & Color developing replenisher The same as in Example 2. | |
| Bleaching solution | |
| Ferric diammonium 1,3-propylenediaminetetraacetate | 0.12 mols |
| 1,3-propylenediaminetetraacetic acid | 5 g |
| Ammonium bromide | 100 g |
| Glacial acetic acid | 50 g |
| Ammonium nitrate | 40 g |
| Add water to make | 1 liter |
| Adjust pH with aqueous ammonia or glacial acetic acid to be | pH 3.4 |
| Bleaching replenisher | |
| Ferric diammonium 1,3-propylenediaminetetraacetate | 0.17 mols |
| 1,3-propylenediaminetetraacetic acid | 7 g |
| Ammonium bromide | 142 g |
| Glacial acetic acid | 70 g |
| Ammonium nitrate | 57 g |
| Add water to make | 1 liter |
| Adjust pH with aqueous ammonia or glacial acetic acid to be | pH 3.4 |
| Fixing solution | |
| Ammonium thiosulfate | 140 g |
| Sodium bisulfite anhydrous | 20 g |
| Sodium metabisulfite | 40 g |
| Add water to make | 1 liter |
| Adjust pH with glacial acetic acid or aqueous ammonia to be | pH 6.5 |

The results of the discoloration ratio, yellow stain production and scratches were obtained as same as in Example 2.

Example 8

The same experiments as in Example 2 were tried, except that the bleaching agent (i.e., ferric ammonium 1,3-propylenediamine tetraacetate) of the bleaching solution and bleaching replenisher used in Example 2 was replaced by ferric ammonium given as Exemplified Compound (B-2) and ferric ammonium given as Exemplified Compound (B-1), respectively. Resultingly, the bleach-fog density was reduced by 20% and the other results were almost the same as in Example 2.

Example 9

The same experiments as in Experiment No.2-12 of Example 2 were tried, except that layer hardener (H-2) contained in the film samples used in Experiment No 2-12 of Example 2 was replaced by the layer hardeners shown in the following Table 4.

The results thereof will be given collectively in Table 4.

TABLE 4

| Experiment No. | Layer hardener | Scratch produced | Yellow stain |
|---|---|---|---|
| 4- 1 | Exemplified (VS- 2) | ∘ | 0.02 |
| 4- 2 | Exemplified (VS- 4) | ∘ | 0.01 |
| 4- 3 | Exemplified (VS- 6) | ∘ | 0.01 |
| 4- 4 | Exemplified (VS- 9) | Δ~∘ | 0.02 |
| 4- 5 | Exemplified (VS-10) | ∘ | 0.01 |
| 4- 6 | Exemplified (VS-12) | Δ~∘ | 0.01 |
| 4- 7 | Exemplified (VS-22) | ∘ | 0.02 |
| 4- 8 | Exemplified (VS-33) | ∘ | 0.01 |
| 4- 9 | Exemplified (VS-54) | Δ~∘ | 0.02 |
| 4-10 | RH-1 given below | Δ | 0.04 |
| 4-11 | RH-2 given below | Δ~X | 0.04 |

TABLE 4-continued

| Experiment No. | Layer hardener | Scratch produced | Yellow stain |
|---|---|---|---|
| 4-12 | RH-3 given below | Δ | 0.04 |
| 4-13 | RH-4 given below | Δ | 0.04 |
| 4-14 | RH-5 given below | Δ | 0.04 |

In the table, Exemplified compounds (VS-2) and (VS-4) were the same as those given in JP Application No. 2-6/1990, pp. 122–128.

(RH-1)

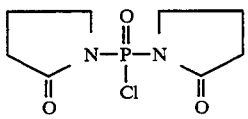

(RH-2)

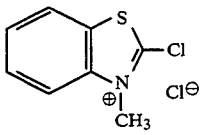

(RH-3)

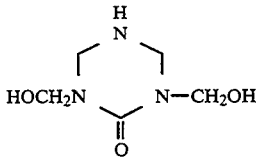

$[NaO_3SO(CH_2)_2O_2S—H_2C]_4C$ (RH-4)

(RH-5)

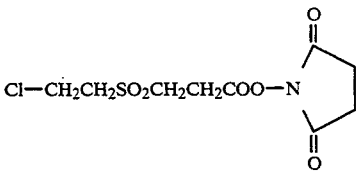

It was proved from the above-given table that the effects of the objects of the invention can be more excellently displayed, when making combination use of a vinylsulfone type layer hardener and the processing method of the invention.

Example 10

Multilayered color light sensitive material 2 was prepared by coating each of the layers having the following compositions on a sublayered triacetyl cellulose film support in order from the support side. The amounts of each layer component coated were indicated by g/m$^2$, provided, the amounts of the silver halides coated were indicated by converting them into the silver contents.

| | |
|---|---|
| Layer 1 : (An antihalation layer) | |
| Black colloidal silver | 0.27 |
| UV absorbent UV-1 | 0.14 |
| UV absorbent UV-2 | 0.07 |
| UV absorbent UV-3 | 0.07 |
| UV absorbent UV-4 | 0.07 |
| High boiling solvent Oil-1 | 0.31 |
| High boiling solvent Oil-2 | 0.098 |
| Polyvinyl pyrrolidone | 0.15 |
| Gelatin | 2.0 |
| Layer 2 : (An interlayer) | |
| High boiling solvent Oil-1 | 0.15 |
| Gelatin | 1.17 |
| Layer 3 : (A low-speed red-sensitive layer) | |
| AgBrI emulsion spectrally sensitized by red-sensatizing dyes (S-1, S-2), (having an AgI content of 3.0 mol % and an average grain size of 0.33 μm) | 0.60 |
| Coupler C-1 | 0.37 |
| High boiling solvent Oil-2 | 0.093 |
| Polyvinyl pyrrolidone | 0.075 |
| Gelatin | 1.35 |
| Layer 4 : (A high-speed red-sensitive emulsion) | |
| AgBrI emulsion spectrally sensitized by red-sensitizing dyes (S-1, S-2), (having an AgI content of 3.0 mol % and an average grain size of 0.8 μm) | 0.60 |
| Coupler C-1 | 0.85 |
| High boiling solvent Oil-2 | 0.21 |
| Polyvinyl pyrrolidone | 0.093 |
| Gelatin | 1.56 |
| Layer 5 : (An interlayer) | |
| Color mixation inhibitor AS-1 | 0.20 |
| High boiling solvent Oil-3 | 0.25 |
| Matting agent MA-1 | 0.009 |
| Gelatin | 1.35 |
| Layer 6 : (A low-speed green-sensitive layer) | |
| AgBrI emulsion spectrally sensitized by red-sensitizing dye (S-3), (having an AgI content of 2.7 mol % and an average grain size of 0.30 μm) | 0.70 |
| Coupler M-1 | 0.33 |
| Coupler M-2 | 0.074 |
| High boiling solvent Oil-3 | 0.059 |
| Polyvinyl- -.pyrrolidone | 0.074 |
| Gelatin | 1.30 |
| Layer 7 : (A high-speed green-sensitive layer) | |
| AgBrI emulsion spectrally sensitized by red-sensitizing dye (S-3), (having an AgI content of 2.7 mol % and an average grain size of 0.8 μm) | 0.70 |
| Coupler M-1 | 0.80 |
| Coupler M-2 | 0.22 |
| Color mixation inhibitor AS-1 | 0.055 |
| High boiling solvent Oil-3 | 0.16 |
| Polyvinyl pyrrolidone | 0.12 |
| Gelatin | 1. 91 |
| Layer 8 : (An interlayer) | |
| Gelatin | 0.90 |
| Layer 9 : (A yellow filter layer) | |
| Yellow colloidal silver | 0.11 |
| Color mixation inhibitor AS-1 | 0.068 |
| High boiling solvent Oil-3 | 0.085 |
| Matting agent MA-1 | 0.01 |
| Gelatin | 0.68 |
| Layer 10: (A low-speed blue-sensitive layer) | |
| AgBrI emulsion spectrally sensitized by red-sensitizing dye (S-4), (having an AgI content of 2.8 mol % and an average grain size of 0.30 μm) | 0.70 |
| Coupler Y-1 | 0.86 |
| Image stabilizer G-1 | 0.012 |
| High boiling solvent Oil-3 | 0.22 |
| Polyvinyl pyrrolidone | 0.078 |
| Compound F-1 | 0.020 |
| Compound F-2 | 0.040 |
| Gelatin | 1.1 |
| Layer 11: (A high-speed blue-sensitive layer) | |
| AgBrI emulsion spectrally sensitized by red-sensitizing dye (S-4), (having an AgI content of 3.0 mol % and an average grain size of 0.85 μm) | 0.70 |
| Coupler Y-1 | 1.24 |
| Image stabilizer G-1 | 0.017 |
| High boiling solvent Oil-3 | 0.31 |
| Polyvinyl pyrrolidone | 0.12 |
| Compound F-1 | 0.039 |
| Compound F-2 | 0.077 |
| Gelatin | 1.73 |
| Layer 12: (Protective layer 1) | |
| Non-light-sensitive finely grained silver iodobromide emulsion (having an AgI content of 1.0 mol % and an average grain size of 0.08 μm) | 0.075 |
| UV absorbent UV-1 | 0.048 |

-continued

| | |
|---|---|
| UV absorbent UV-2 | 0.024 |
| UV absorbent UV-3 | 0.024 |
| UV absorbent UV-4 | 0.13 |
| High boiling solvent Oil-1 | 0.13 |
| High boiling solvent Oil-2 | 0.13 |
| Compound F-1 | 0.077 |
| Compound F-2 | 0.15 |
| Gelatin | 1.2 |
| Layer 13: (Protective layer 2) | |
| Sliding agent WAX-1 | 0.04 |
| Matting agent MA-2 | 0.0090 |
| Matting agent MA-3 | 0.052 |
| Surfactant SU-1 | 0.0036 |
| Gelatin | 0.55 |

(Note: The weight average molecular weight of the polyvinyl pyrrolidones used in the layers were each 350,000.)

Besides the above components, gelatin layer hardeners H-1, H-2 and H-3, water-soluble dyes AI-1, AI-2 and AI-3, antimold DI-1, stabilizer ST-1 and antifoggant AF-1 were each suitably added into the sample so as to meet the requirements.

The silver halide emulsions applied to each of the layers were prepared with reference to the preparation procedures for Example 1 given in JP OPI Publication No. 59-178447/1984. Every one of the resulting emulsions was a monodisperse type emulsion having a distribution range of not more than 20%. After demineralizing and washing the emulsions, they were subjected to the optimum chemical ripening treatment in the presence of sodium thiosulfate, chloroauric acid and ammonium thiocyanate and they were then added by the sensitizing dyes, 4-hydroxy-6-methyl-1,3, 3*a*, 7-tetrazaindene and 1-phenyl-5-mercaptotetrazole.

Distribution range (%) = (Standard grain size deviation/ Average grain size) × 100

S-1

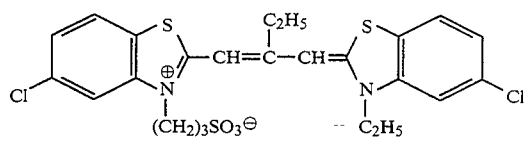

S-2

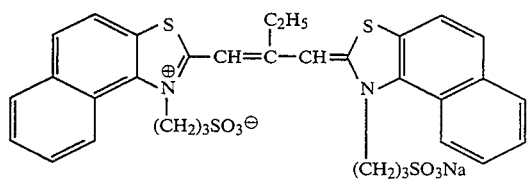

S-3

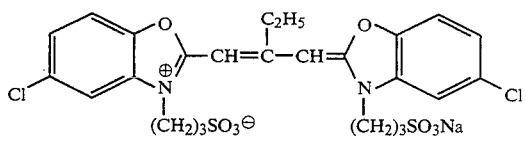

S-4

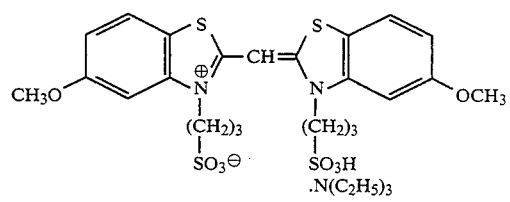

<Coupler>

C-1

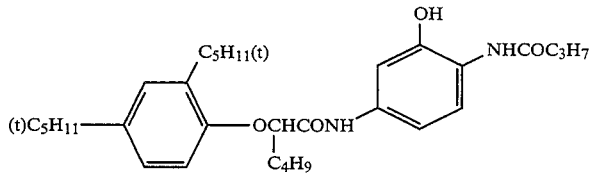

M-1

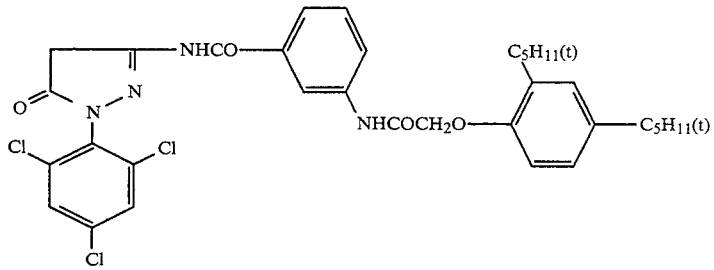

M-2

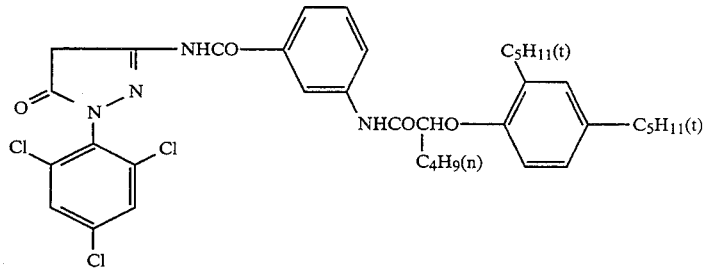

-continued

Y-1

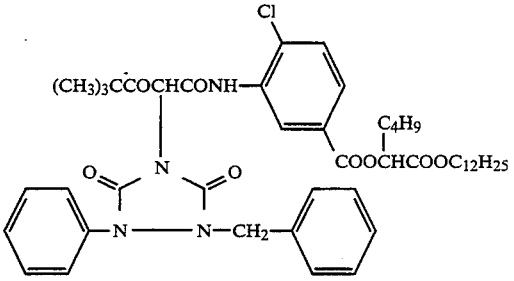

<Compound>

F-1

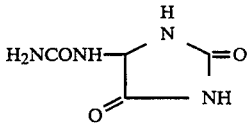

F-2

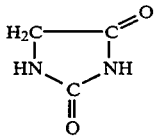

<Matting agent>

MA-1: Colloidal silica particles (having an average particle size of 3.5 μm)

MA-2: Polymethyl methacrylate particles (having an average particle size of 3.0 μm)

<Matting agent>

MA-1: Colloidal silica particles (having an average particle size of 3.5 μm)

MA-2: Polymethyl methacrylate particles (having an average particle size of 3.0 μm)

MA-3:

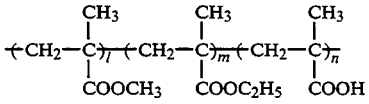

(l:m:n: = 30:30:40) (by weight)

<UV absorbent>

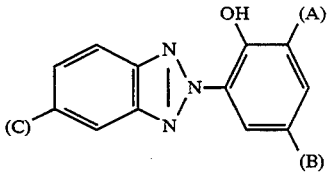

| | A | B | C |
|---|---|---|---|
| UV-1 | —H | —$C_4H_9$ (t) | —H |
| UV-2 | —$C_4H_9$ (t) | —$C_4H_9$ (t) | —H |
| UV-3 | —$C_4H_9$ (t) | —$CH_3$ | —Cl |
| UV-4 | —$C_4H_9$ (t) | —$C_4H_9$ (t) | —Cl |

| <High boiling solvent> | |
|---|---|
| Oil-1 | Di-2-ethylhexyl phthalate |
| Oil-2 | Dibutyl phthalate |

-continued

| <High boiling solvent> | |
|---|---|
| Oil-3 | Tricresyl phosphate |

<Color mixation inhibitor>

AS-1

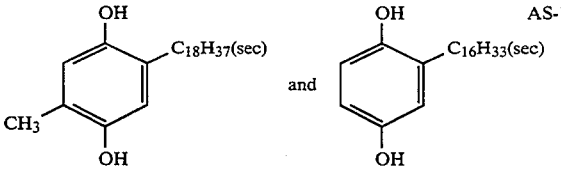

(mixture of 2:3)

<Image stabilizer>

G-1

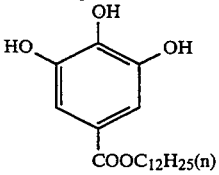

<Sliding agent>

WAX-1

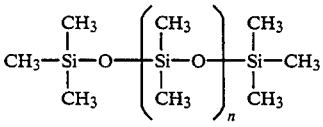

(Weight average molecular weight: 30,000)

<Surfactant>

SU-1

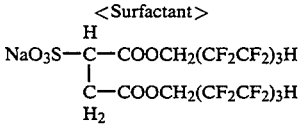

<Layer hardener>

H-1

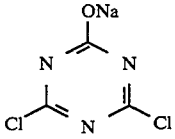

H-2

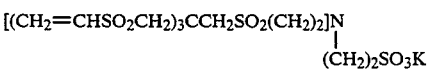

-continued $(CH_2{=}CH{-}SO_2CH_2)_2O$ H-3

-continued

AF-1

<Water-soluble dye>

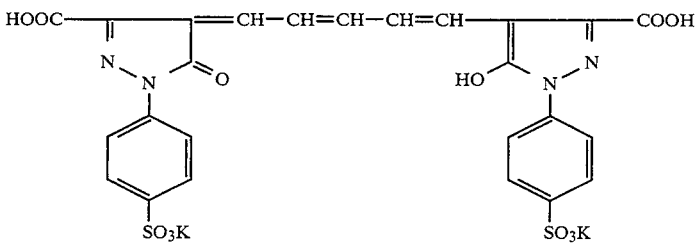

AI-1

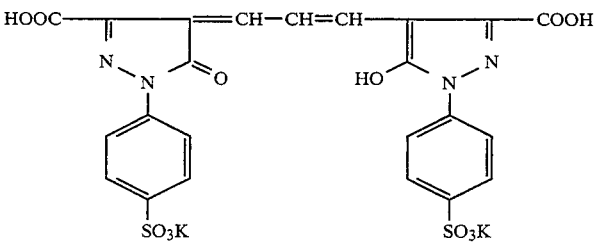

AI-2

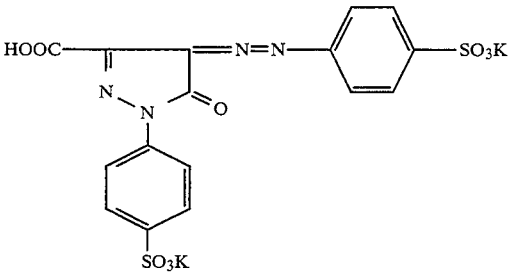

AI-3

<Antimold>

(A mixture of the following 3 components)

DI-1

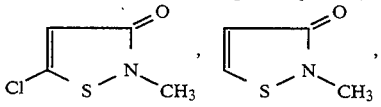

(Component A) (Component B)

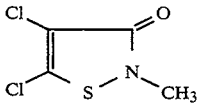

(Component C)

Components, A:B:C = 50:46:4 (in mol ratio)

<Stabilizer>

ST-1

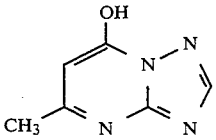

<Antifoggant>

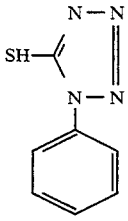

The resulting Sample B was photographically exposed to light by making use of a Konica FS-1 camera (manufactured by Konica Corp.) and was then continuously processed under the following conditions.

TABLE 5

| Processing step | Processing time | Processing temperature | Amount replenished* |
|---|---|---|---|
| Developing 1 | 6 min. | 38 ± 0.3° C. | 2150 ml |
| Washing | 2 min. | 33~39° C. | 7.5 l/min. |
| Reversing | 2 min. | 33~39° C. | 1100 ml |
| Color developing | 6 min. | 38 ± 0.6° C. | 2150 ml |
| Adjusting | 2 min. | 33~39° C. | 800 ml |
| Bleaching | 6 min. | 38 ± 2.0° C. | 140 ml |
| Fixing | 2 min. | 38 ± 9.0° C. | 800 ml |
| Washing | 4 min. | 33~39° C. | 7.5 l/min. |
| Stabilizing | 1 min. | 38 ± 5.0° C. | 800 ml |
| Drying | 1 min. 30 sec. | 38 ± 5.0° C. | — |

(*Amounts replenished were each indicated by a value per sq. meter of a subject light sensitive material)

In the above-given processing steps, the compositions of the processing solutions used were as follows.

| | |
|---|---|
| Developing solution 1 | |
| Sodium tetrapolyphosphate | 2 g |
| Sodium sulfite | 20 g |
| Hydroquinone-monosulfonate | 30 g |
| Sodium carbonate (monohydrate) | 30 g |
| 1-phenyl-4-methyl-4-hydroxymethyl-3-pyrazolidone | 2 g |
| Potassium bromide | 2.5 g |
| Potassium thiocyanate | 1.2 g |
| Potassium iodide (in a 0.1% solution) | 2 ml |
| Add water to make | 1000 ml |
| Adjust pH to be | (pH 9.60) |
| Developing replenisher 1 | |
| Sodium tetrapolyphosphate | 2 g |
| Sodium sulfite | 20 g |
| Hydroquinone-monosulfonate | 30 g |
| Sodium carbonate (monohydrate) | 30 g |
| 1-phenyl-4-methyl-4-hydroxymethyl-3-pyrazolidone | 2 g |
| Potassium bromide | 1.0 g |
| Potassium thiocyanate | 1.2 g |
| Potassium iodide (in a 0.1% solution) | 0.5 ml |
| Add water to make | 1000 ml |
| Adjust pH to be | (pH 9.65) |
| Reversing solution & reversing replenisher | |
| Hexasodium nitrilotrimethylene phosphonate | 3 g |
| Stannous chloride (dihydrate) | 1 g |
| p-aminophenol | 0.1 g |
| Sodium hydroxide | 8 g |
| Glacial acetic acid | 15 ml |
| Add water to make | 1000 ml |
| Adjust pH to be | (pH 5.75) |
| Color developing solution | |
| Sodium tetrapolyphosphate | 3 g |
| Sodium sulfite | 7 g |
| Tertiary sodium phosphate (dihydrate) | 36 g |
| Potassium bromide | 1 g |
| Potassium iodide (in a 0.1% solution) | 90 ml |
| Sodium hydroxide | 3 g |
| Citrazinic acid | 1.5 g |
| N-ethyl-N-β-methanesulfonamidoethyl-3-methyl-4-aminoaniline sulfonate | 11 g |
| 2,2-ethylenedithioethanol | 1 g |
| Add water to make | 1000 ml |
| Adjust pH to be | (pH 11.70) |
| Color developing replenisher | |
| Sodium tetrapolyphosphate | 3.8 g |
| Sodium sulfite | 8.8 g |
| Tertiary sodium phosphate (dihydrate) | 45 g |
| Sodium hydroxide | 3.8 g |
| Citrazinic acid | 1.9 g |
| N-ethyl-N-β-methanesulfonamidoethyl-3-methyl-4-aminoaniline sulfonate | 13 g |
| 2,2-ethylenedithioethanol | 1.2 g |
| Add water to make | 1000 ml |
| Adjust pH to be | (pH 11.95) |
| Controlling solution & controlling replenisher | |
| Sodium sulfite | 12 g |
| Sodium ethylenediamine tetraacetate | 8 g |
| Thioglycerol | 0.4 ml |
| Glacial acetic acid | 3 ml |
| Add water to make | 1000 ml |
| Adjust pH to be | (pH 6.15) |
| Bleaching solution | |
| Sodium ethylenediamine tetraacetate (dihydrate) | 2 g |
| Iron (III) ammonium ethylenediamine tetraacetate (dihydrate) | 120 g |
| Ammonium bromide | 100 g |
| Add water to make | 1000 ml |
| Adjust pH to be | (pH 5.65) |
| Bleaching replenisher | |
| Sodium ethylenediamine tetraacetate (dihydrate) | 4 g |
| Iron (III) ammonium ethylenediamine tetraacetate (dihydrate) | 240 g |
| Ammonium bromide | 200 g |
| Add water to make | 1000 ml |
| Adjust pH to be | (pH 5.40) |
| Fixing solution & fixing replenisher | |
| Ammonium thiosulfate | 120 g |
| Ammonium thiocyanate | 100 g |

-continued

| | |
|---|---|
| Sodium sulfite | 5 g |
| Sodium bisulfite | 5 g |
| Add water to make | 1000 ml |
| Adjust pH to be | (pH 6.60) |
| Stabilizing solution & stabilizing replenisher | |

In the automatic processor used for the continuous processing, it had a transport speed of 20 m/min. and a thermostat circulation filter and a replenishing inlet were provided to each of the tanks thereof. It had the same functions as in the automatic processors for color reversal film use, which are generally available on the market.

The every evaluation was carried out in the same manner as in Example 2. Almost the same results thereof were obtained as in Example 2.

Example 11

The same experiments as in Example 2 were tried, except that the additives given .in the foregoing Table 2 of Example 2 were added into the fixing solution used in Example 2 and the same stabilizing solution as in Experiment No. 2-1 was used. Resultingly, the discoloration ratios of each samples and the scratches produced thereon were deteriorated by about 10 to 20%. However, the samples containing the compounds of the invention were each proved to be practicable.

Example 12

The same experiments as in Example 2 were tried, except that the amount of stabilizing solution being replenished was varied as in the Table 6.

TABLE 6

| Experiment No. | Stabilizer Replenishing (ml/m$^2$) | Discoloration ratio (%) | Yellow stain | Preservation (sulfurized) |
|---|---|---|---|---|
| 6-1*A | 750 | 6.7 | 0.00 | 2 days |
| 6-2*A | 650 | 6.9 | 0.01 | 2 days |
| 6-3*A | 620 | 15 | 0.10 | 1 days |
| 6-4*A | 400 | 22 | 0.12 | 1 days |
| 6-5*B | 750 | 30 | 0.11 | 4 days |
| 6-6*B | 650 | 31 | 0.11 | 4 days |
| 6-7*B | 620 | 46 | 0.19 | 1 days |
| 6-8*B | 400 | 50 | 0.22 | 1 days |
| 6-9*C | 750 | 66 | 0.00 | 11 days |
| 6-10*C | 650 | 6.7 | 0.00 | 11 days |
| 6-11*C | 620 | 6.9 | 0.00 | 10 days |
| 6-12*C | 500 | 7.5 | 0.00 | 10 days |

N.B. *A = 35% of formaldehyde 0.6 ml was added.
*B = 2.5 g of hexamethylenetetramine was added.
*C = 2.5 g of exemplified compound (I-1) was added.

As is obvious from Table 6, it can be proved that when replenishing amount of the stabilizing solution reduced to less than 620 ml/m$^2$, discoloration, yellowing and shorter preservation quality are occurred, however, by using a compound of the invention, those defects do not appear even at 620 ml/m$^2$ of replenishing amount of the stabilizer. The processing solution of the invention can stand against low replenishing process.

According to the invention, a processing solution for color photographic use and the processing method thereof can be provided, in which any dye discoloration can be prevented at a low humidity even if any aldehyde is not substantially contained; the scratch resistance of light sensitive materials can be excellent; the solution preservability can be excellent; a processing solution hardly sulfurized in particular; the yellow stain prevention can be improved in the unexposed portions;

and the safety of the working atmospheric conditions can also improved.

What is claimed is:

1. A method of processing a silver halide color photographic light-sensitive material comprising:

imagewise exposing to light, color developing, bleaching, fixing and thereafter, stabilizing said material, wherein said stabilizing step is carried out with a stabilizer solution comprising a compound represented by formula I,

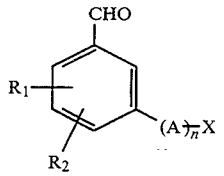

Formula I wherein A represents $$-CH_2-,\ -CH_2\overset{CH_3}{\overset{|}{C}}H-,\ -CH_2\overset{OH}{\overset{|}{C}}HCH_2-\ \text{or}\ -\overset{CH_3}{\overset{|}{C}}H-CH_2-;$$

X represents a hydroxyl group, a sulfonic acid group, a carboxylic acid group, an amino group, a sulfonamido group, a sulfamoyl group, a carbamoyl group, a sulfinic acid group or a sulfonyl group; n is an integer of 0 or 1 through 3; $R_1$ and $R_2$ each represent a hydrogen atom, an alkoxy group, a $C_1$ or $C_2$ alkyl group which may have a hydroxy or carboxy group, an aldehyde group, a hydroxyl group, a carboxylic acid group or a sulfonic acid group, and $R_1$ and $R_2$ may be the same or different.

2. The method of claim 1, wherein $R_1$ and $R_2$ of formula I each represent a hydrogen atom, an alkoxy group, a $C_1$ or $C_2$ alkyl group which may have a hydroxy or carboxy group, a hydroxy group, a carboxylic acid group or a sulfonic acid group, and $R_1$ and $R_2$ may be the same or different.

3. The method of claim 2, wherein the stabilizer contains the compound represented by formula I in an amount of 0.1 g to 15 g per liter.

4. The method of claim 2, wherein $R_1$ and $R_2$ are hydrogen atoms.

5. The method of claim 2, wherein X is a hydroxyl group and n is 0.

6. The method of claim 1, further comprising at least one of the compounds selected from the group consisting of the compound represented by the following formulae SI, SII, and water-soluble organic siloxane compounds, $$R^1-X-(E^1)_{l1}(E^2)_{m1}(E^3)_{n1}-R^2$$

Formula SI wherein $R^1$ represents a hydrogen atom, an aliphatic group or an acyl group; $R^2$ represents a hydrogen atom or an aliphatic group; $E^1$ represents an ethylene oxy group; $E^2$ represents a propyleneoxy group; $E^3$ represents an ethylene oxy group; and X represents an oxygen atom or a $-R^3N-$group in which $R^3$ represents an aliphatic group, a hydrogen atom or $$(E^1)_{l2}(E^2)_{m2}(E^3)_{n2}-R^4$$

in which $E^1$ represents an ethyleneoxy group; $E^2$ represents a propyleneoxy group; $E^3$ represents an ethyleneoxy group;

$R^4$ represents a hydrogen atom or an aliphatic group; $l_1$, $l_2$, $m_1$, $m_2$, $n_1$ and $n_2$ are each an integer of 0 to 300, provided, $l_1+l_2+m_1+m_2+n_1+n_2 \geqq 8$;

$$A_2-O-(B)_m(C)_n-X_1$$

Formula SII wherein $A_2$ represents a monovalent organic group selected from the group consisting of $C_6$—$C_{50}$ alkyl, and aryl substituted with a $C_3$—$C_{35}$ alkyl; B and C are individually selected from the group consisting of an ethylene oxy group, a propylene oxy group and $$(CH_2)_{n1}(\underset{OH}{\underset{|}{C}H})_{m1}(CH_2)_{l1}O-,$$

provided $n_1$, $m_1$ and $l_1$ are each an integer of 0, 1, 2 or 3; m and n are each an integer of 0 through 100; and $X_1$ represents a hydrogen atom, an alkyl group, an aralkyl group or an aryl group.

7. The method of claim 6, wherein said water-soluble organic siloxane compound is represented by the formula SU-I

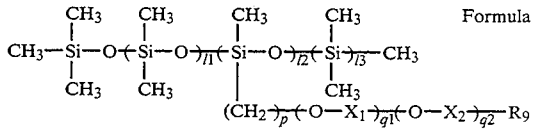

Formula SU-I wherein $R_9$ represents a hydrogen atom, a hydroxy group, an alkyl group having not more than 6 carbon atoms, an alkoxy group,

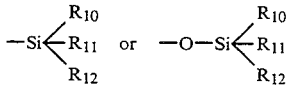

in which $R_{10}$, $R_{11}$ and $R_{12}$ represent each a hydrogen atom or an alkyl group having not more than 6 carbon atoms, provided $R_{10}$, $R_{11}$ and $R_{12}$ may be same or different; $l_1$ through $l_3$ represent each an integer of 0 or 1 through 30; p, $q_1$ and $q_2$ represent each 0 or an integer of 1 through 30; and $X_1$ and $X_2$ represent each $$-CH_2CH_2-,\quad -CH_2CH_2CH_2-,$$

$$-CH_2\underset{CH_3}{\underset{|}{C}}H-,\ \text{or}\ -\underset{CH_3}{\underset{|}{C}}H-CH_2-.$$

8. The method of claim 6, wherein an amount of the compound represented by formula SU-I in the solution is 0.01 g to 20 g per liter.

9. A method of processing a silver halide color photographic light-sensitive material comprising:

imagewise exposing to light, color developing, bleach-fixing and thereafter, stabilizing said material, wherein said stabilizing step is carried out with a stabilizer solution comprising a compound represented by formula I,

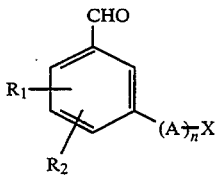

Formula I wherein A represents

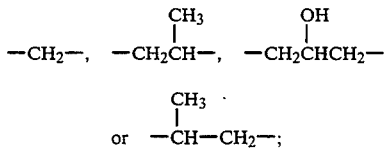

X represents a hydroxyl group, a sulfonic acid group, a carboxylic acid group, an amino group, a sulfonamido group, a sulfamoyl group, a carbamoyl group, a sulfinic acid group or a sulfonyl group; n is an integer of 0 or 1 through 3; $R_1$ and $R_2$ each represent a hydrogen atom, an alkoxy group, a $C_1$ or $C_2$ alkyl group which may have a hydroxy or carboxy group, an aldehyde group, a hydroxyl group, a carboxylic acid group or a sulfonic acid group, and $R_1$ and $R_2$ may be the same or different.

* * * * *